United States Patent [19]

Garrett

[11] 4,434,863

[45] Mar. 6, 1984

[54] DRILL STRING SPLINED RESILIENT TUBULAR TELESCOPIC JOINT FOR BALANCED LOAD DRILLING OF DEEP HOLES

[75] Inventor: William R. Garrett, Houston, Tex.

[73] Assignee: Smith International, Inc., Newport Beach, Calif.

[21] Appl. No.: 216,832

[22] Filed: Dec. 16, 1980

Related U.S. Application Data

[63] Continuation-in-part of Ser. No. 38,674, May 14, 1979, Pat. No. 4,281,726.

[51] Int. Cl.[3] ..... E21B 17/00

[52] U.S. Cl. ..... 175/321; 175/297; 267/162

[58] Field of Search ..... 175/321, 40, 107, 297; 267/161, 162, 160, 125; 184/1 C; 64/23; 277/200

[56] References Cited

U.S. PATENT DOCUMENTS

| | | | |
|---|---|---|---|
| 1,641,059 | 8/1927 | Tausch | 267/162 |
| 2,121,267 | 6/1938 | Shaffer . | |
| 2,309,872 | 2/1943 | Shaffer et al. . | |
| 2,354,709 | 8/1944 | Shaffer . | |
| 2,568,256 | 9/1951 | Shaffer . | |
| 2,610,027 | 9/1952 | Waggener . | |
| 2,675,225 | 4/1954 | Mighy | 267/162 |
| 2,978,048 | 4/1961 | Walker | 175/321 |
| 3,057,418 | 10/1952 | Kopp . | |
| 3,204,992 | 9/1965 | Walker | 285/330 |
| 3,301,009 | 1/1967 | Coulter, Jr. | 175/321 |
| 3,383,126 | 5/1968 | Salvatori | 175/321 |
| 3,403,917 | 10/1968 | MacSpadden | 277/200 |
| 3,670,319 | 6/1972 | Ohtani | 184/1 C |
| 4,074,775 | 2/1978 | Lee | 175/163 |
| 4,133,516 | 1/1979 | Jürgens | 175/321 |
| 4,139,994 | 2/1979 | Alther | 175/321 |
| 4,162,619 | 7/1979 | Nixon, Jr. | 175/321 |
| 4,186,569 | 2/1979 | Aumann | 175/321 |
| 4,194,582 | 3/1980 | Ostertag | 175/321 |
| 4,240,610 | 12/1980 | Trimble | 277/200 |

*Primary Examiner*—William F. Pate, III

*Attorney, Agent, or Firm*—Murray Robinson; Ned L. Conley; David A. Rose

[57] ABSTRACT

A drill string splined resilient tubular telescopic joint for balanced load deep weel drilling comprises a double acting damper having a very low spring rate upon both extension and contraction from the zero deflection condition. Stacks of spring rings are employed for the spring means, the rings being either shaped elastomer-metal sandwiches or, preferably, roller Belleville springs. The spline and spring means are disposed in an annular chamber formed by mandrel and barrel members constituting the telescopic joint. The chamber containing the spring means, and also containing the spline means, is filled with lubricant, the chamber being sealed with a pressure seal at its lower end and an inverted floating seal at its upper end.

A prototype includes of this a bellows seal instead of the floating seal at the upper end of the tool, and a bellows in the side of the lubricant chamber provides volume compensation. A second lubricant chamber is provided below the pressure seal, the lower end of the second chamber being closed by a bellows seal and a further bellows in the side of the second chamber providing volume compensation.

Modifications provide hydraulic jars.

57 Claims, 33 Drawing Figures

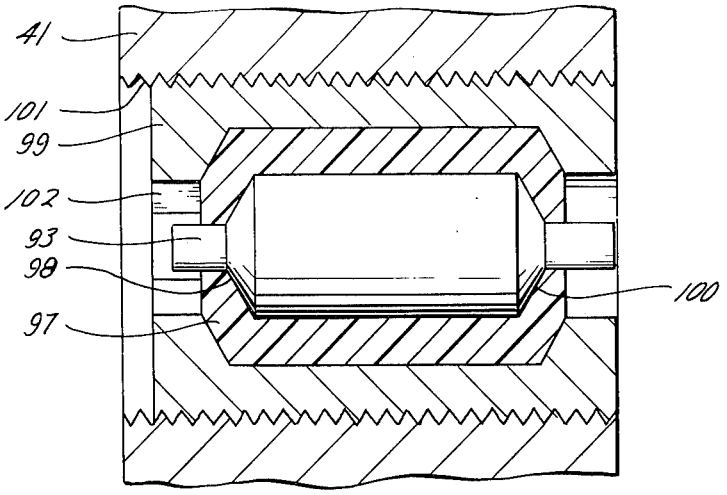
Fig. 1A
Fig. 5A
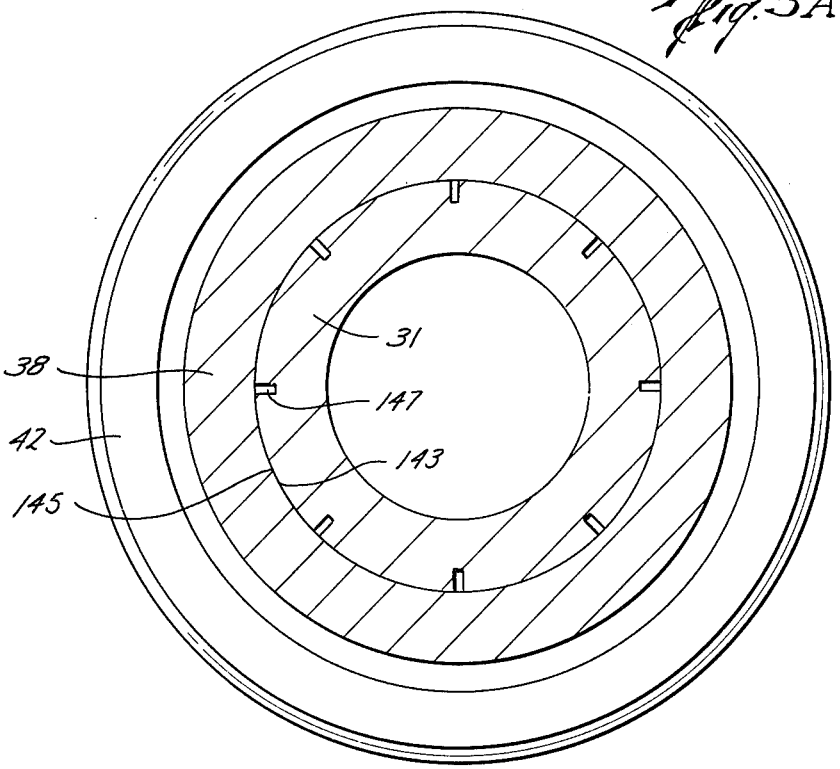

Fig. 2A"
41
68
121
31
105
103
101
99
97
93
91
71
69
61
60
70
52
53
62
63
54
55
87
73
56
57
72
64
51
65
82
76
83
85
59
74
58
66
67
77
81
79
208
68
DAMPER OPEN
210
DAMPER CLOSED 131
139
137
6
6
133
41
DAMPER CLOSED
123
DAMPER OPEN
281
125
31
121
68

Fig. 3A"
OPEN
CLOSED
167
162
42
33
177
151
209
189
284
175
282
143
147
145
38
31
5A
33
323
321
183
207
177
217
219
211
215
213
193
195
189
209
282
191
210
175
38
147
42
31
5A
41

45
91
43
278
283
299
277
269
253
245
237
254
246
238
235
276
272
265
239
247
233
257
249
241
255
240
258
248
250
256
242
270
267
274
243
261
251
259
275
244
252
260
47
271
275
231
37
208
DAMPER OPEN
47
299
297
291
293
296
235
37
47
279
DAMPER CLOSED
35

Fig. 4B"

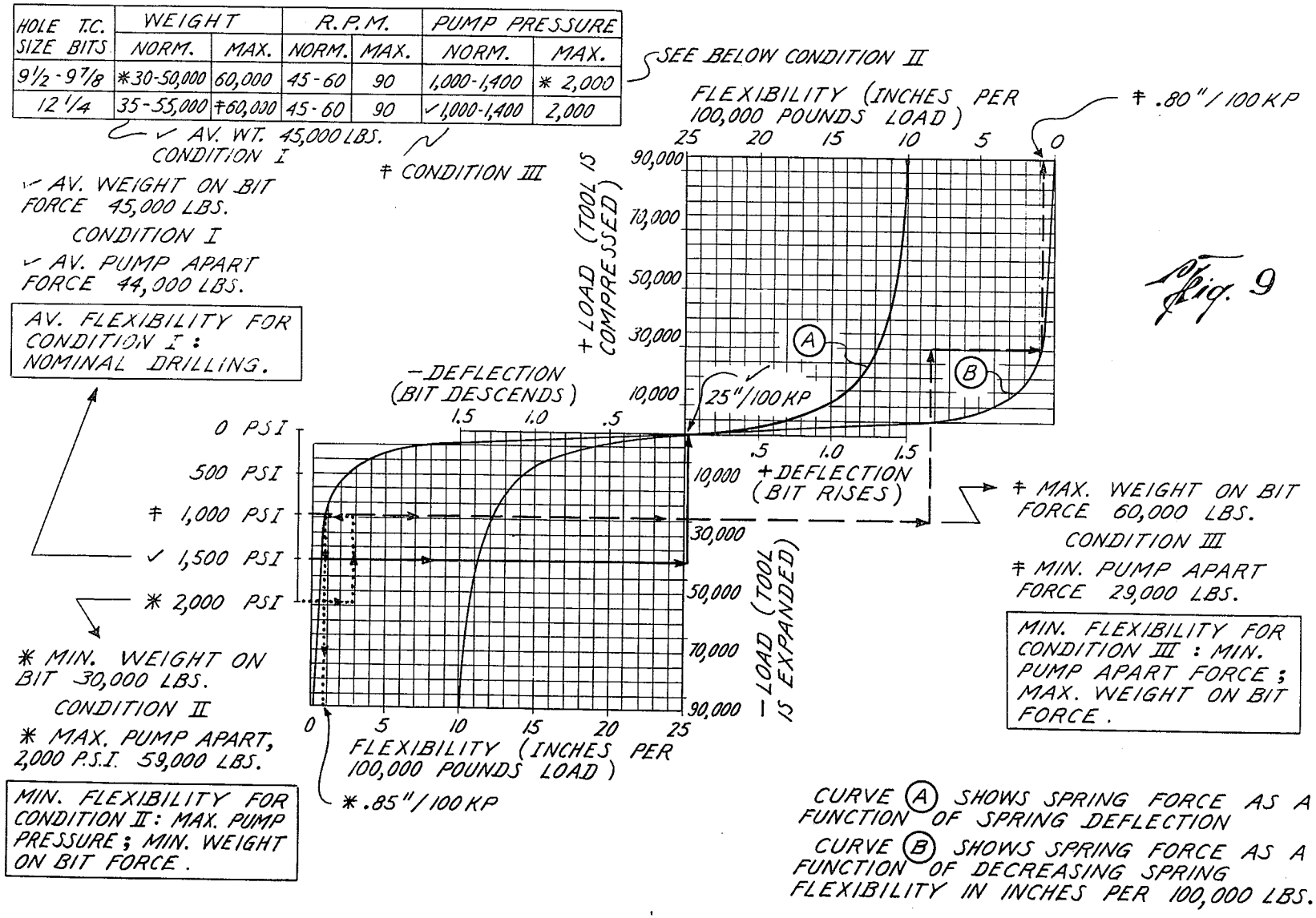
Fig. 9
SEE BELOW CONDITION II
FLEXIBILITY (INCHES PER 100,000 POUNDS LOAD)
‡ .80"/100 KP
+ LOAD (TOOL IS COMPRESSED)
90,000
70,000
50,000
30,000
10,000
25"/100 KP
+ DEFLECTION (BIT RISES)
− LOAD (TOOL IS EXPANDED)
− DEFLECTION (BIT DESCENDS)
FLEXIBILITY (INCHES PER 100,000 POUNDS LOAD)
* .85"/100 KP
‡ MAX. WEIGHT ON BIT FORCE 60,000 LBS.
CONDITION III
‡ MIN. PUMP APART FORCE 29,000 LBS.
MIN. FLEXIBILITY FOR CONDITION III: MIN. PUMP APART FORCE; MAX. WEIGHT ON BIT FORCE.
CURVE (A) SHOWS SPRING FORCE AS A FUNCTION OF SPRING DEFLECTION
CURVE (B) SHOWS SPRING FORCE AS A FUNCTION OF DECREASING SPRING FLEXIBILITY IN INCHES PER 100,000 LBS.
HOLE SIZE | I.C. BITS | WEIGHT NORM. | WEIGHT MAX. | R.P.M. NORM. | R.P.M. MAX. | PUMP PRESSURE NORM. | PUMP PRESSURE MAX.
9 1/2 - 9 7/8 | *30-50,000 | 60,000 | 45-60 | 90 | 1,000-1,400 | * 2,000
12 1/4 | 35-55,000 | ‡60,000 | 45-60 | 90 | ✓1,000-1,400 | 2,000
✓ AV. WT. 45,000 LBS.
‡ CONDITION III
✓ AV. WEIGHT ON BIT FORCE 45,000 LBS.
CONDITION I
✓ AV. PUMP APART FORCE 44,000 LBS.
AV. FLEXIBILITY FOR CONDITION I: NOMINAL DRILLING.
0 PSI
500 PSI
‡ 1,000 PSI
✓ 1,500 PSI
* 2,000 PSI
* MIN. WEIGHT ON BIT 30,000 LBS.
CONDITION II
* MAX. PUMP APART, 2,000 P.S.I. 59,000 LBS.
MIN. FLEXIBILITY FOR CONDITION II: MAX. PUMP PRESSURE; MIN. WEIGHT ON BIT FORCE.

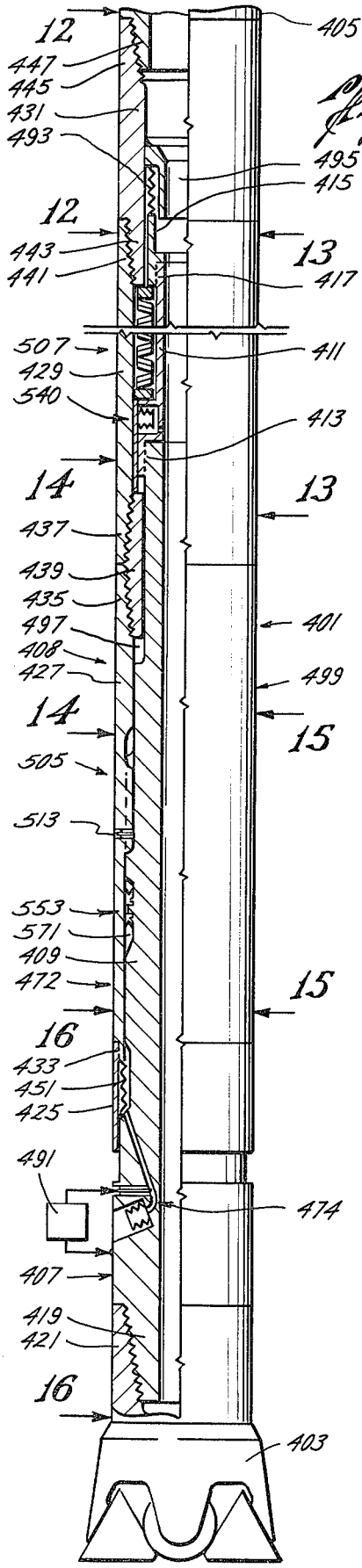
Fig. 11
Fig. 12
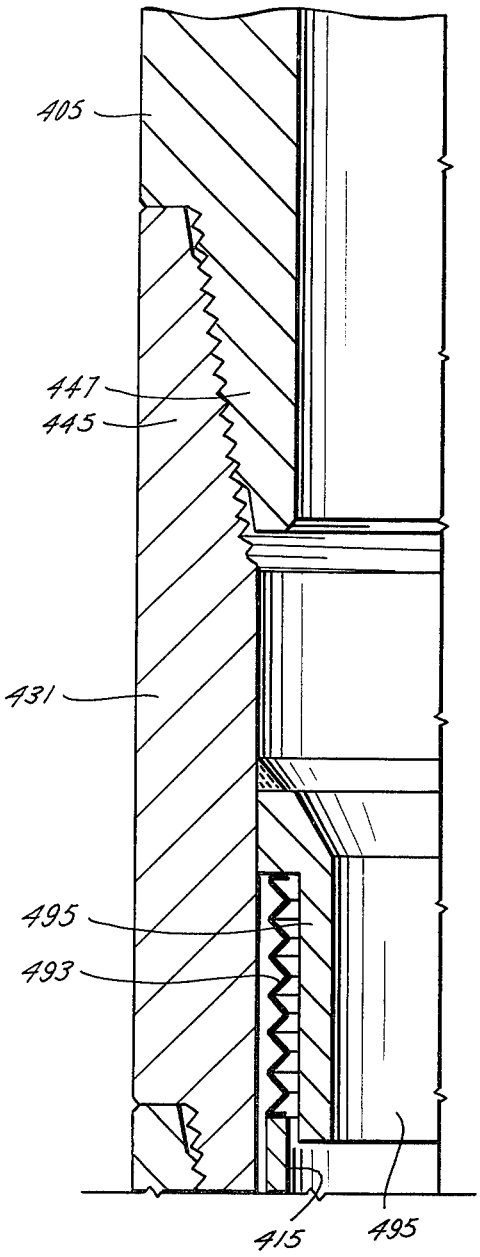

Fig. 13
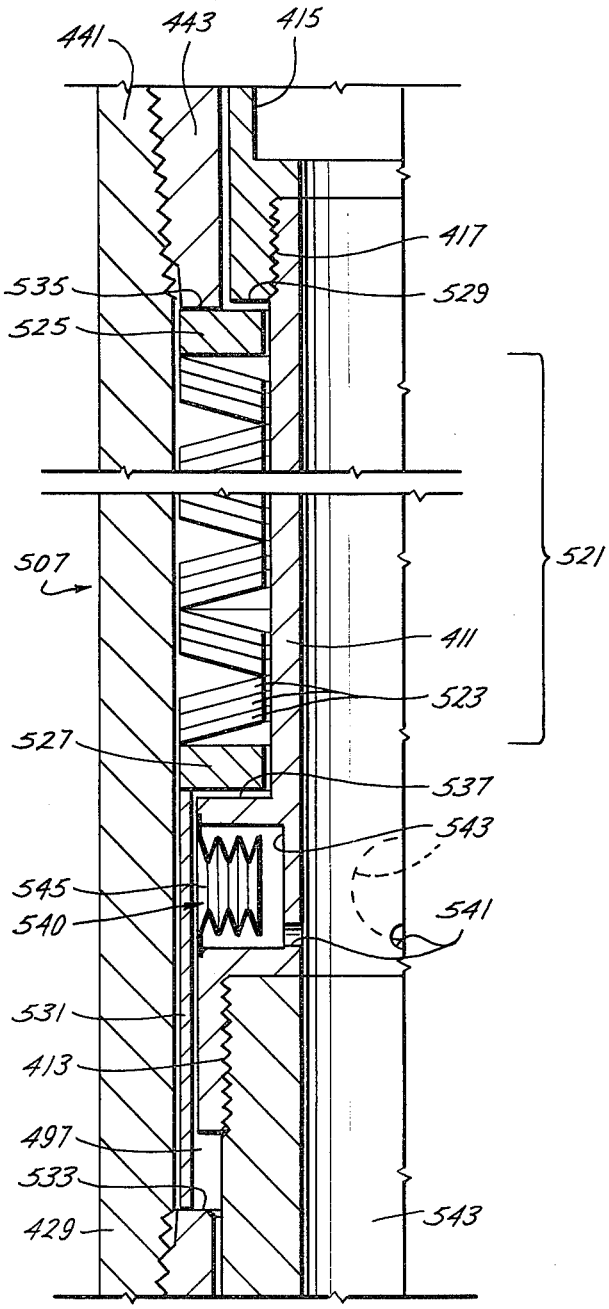
Fig. 14
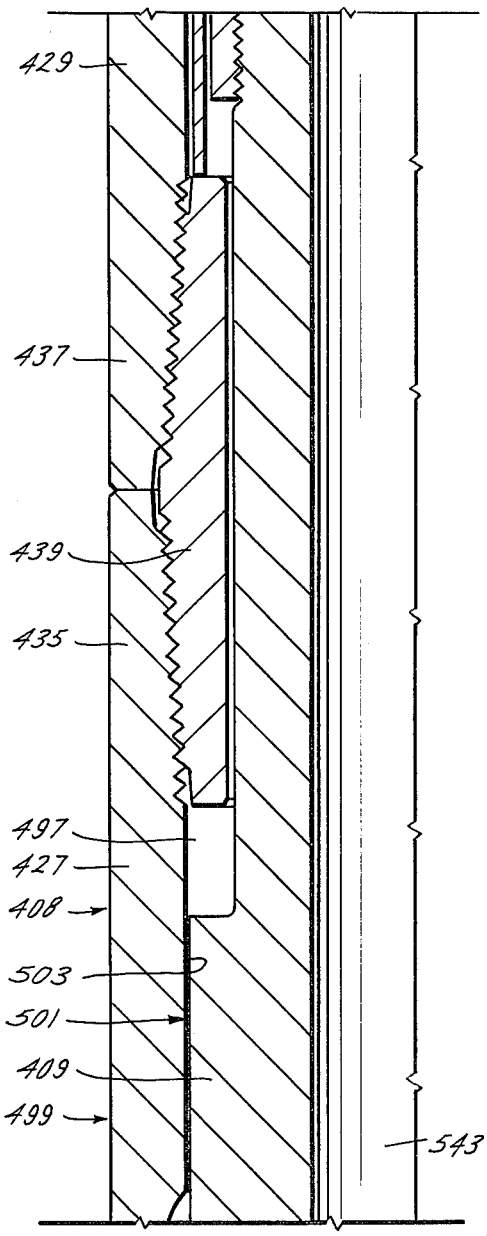
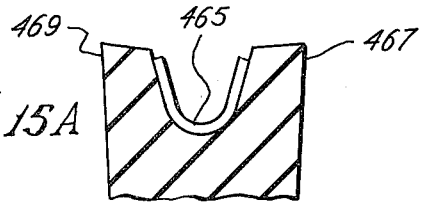
Fig. 15A
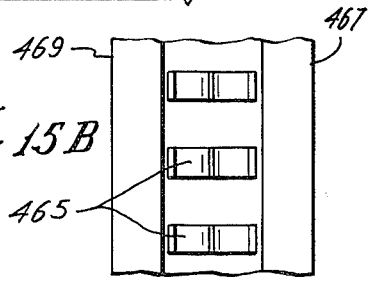
Fig. 15B 1493
1497
1513
1540
1453
1471
2113
2114
2113
2130
2128
2127
2101
22
2123
2131
2139
2115
2109
2111
2143
2103
2145
1439
2105
2107
1407
1409
1499
2129
2121
22
2119
2125
2135
2117
2137
X
Z
Y

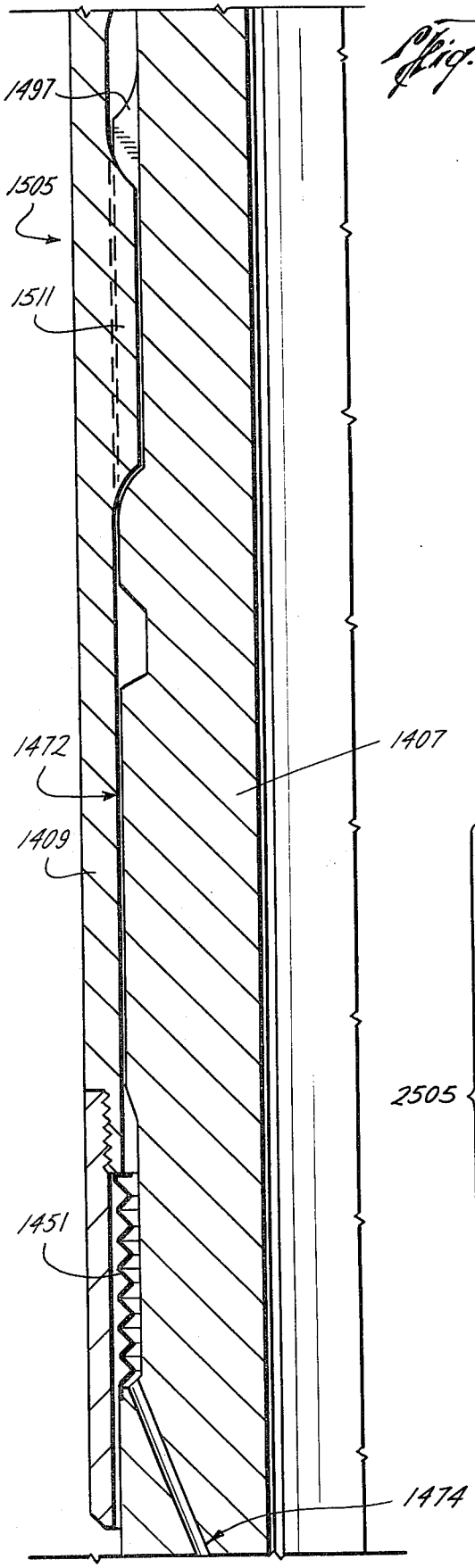
Fig. 21
Fig. 23
MODIFICATION
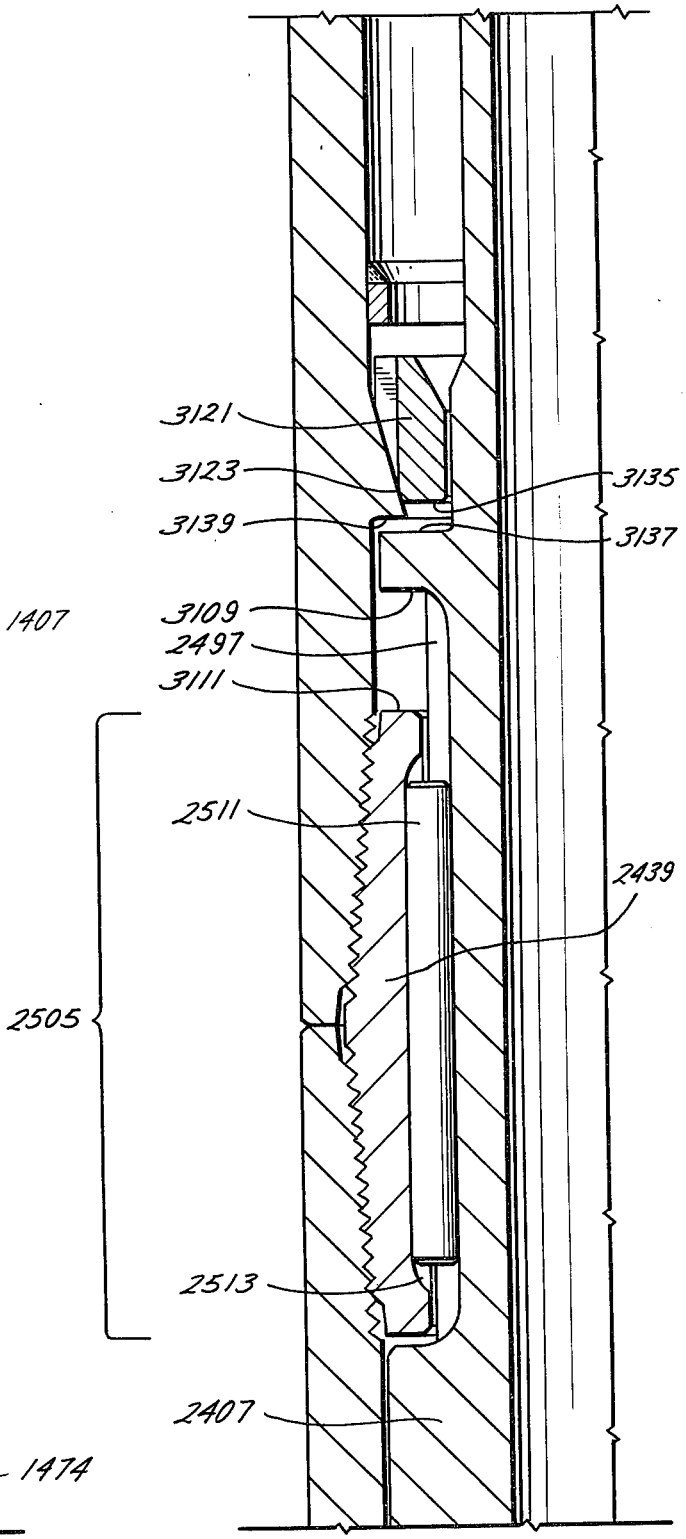

DRILL STRING SPLINED RESILIENT TUBULAR TELESCOPIC JOINT FOR BALANCED LOAD DRILLING OF DEEP HOLES

CROSS REFERENCES TO RELATED APPLICATIONS

This application is a continuation-in-part of applicant's prior copending application Ser. No. 38,674 filed May 14, 1979 by William R. Garrett entitled "Drill String Splined Resilient Tubular Telescopic Joint For Balanced Load Drilling of Deep Holes", now U.S. Pat. No. 4,281,726.

Background of the Invention a. Field of the Invention

This invention relates to earth boring tools, and more particularly to drill string resilient units useful in earth boring by the rotary system of drilling, such tools sometimes being called vibration dampers or shock absorbers, and relates specifically to drill string splined resilient tubular telescopic joint.

b. Objects of the Invention

A principal object of the invention is to provide such a tool especially adapted for balanced load drilling, i.e. where the drilling weight and pump apart force are equal. Though the tool is specially intended for balanced load drilling, the tool may also be used with advantage under such other load conditions as may normally be expected and includes features of general utility in drill string resilient units.

Other objects and advantages of the invention will appear as the description thereof proceeds.

c. Description of certain Prior Art

It appears that many prior art drill string resilient units have not been intended for use in balanced load drilling. For example, in U.S. Pat. No. 2,991,635—Warren, there is disclosed a tubular telescopic tool employing splines to transmit torque and multiple helical springs in parallel to transmit axial force. Three sets of sliding seals are employed, one above and one below the spline-spring means, and one separating the spline from the springs. The uppermost multiple seal includes upper and lower pairs of O-rings and a lubricating packing therebetween, with a grease fitting to allow injection of grease. However, the spring means come into action only upon contraction of the damper from the no load condition. Warren states that:

"normally the springs 60 will be designed to be compressed substantially half way during a normal drilling operation. However, if a greater or lesser weight is desired on the drill bit 30, the drill string may be lowered or raised a short distance to increase or decrease the compression of the springs 60," (col. 5, lines 50–60).

In U.S. Pat. No. 3,949,150—Mason et al, there is disclosed a sealed, lubricated, splined, resilient, tubular telescopic joint for a drill string wherein contrary to the more usual arrangement the mandrel is connected to the drill string and the barrel or case is connected to the bit. A stack of rubber rings each sandwiched between flanged metal rings serves as a resilient element. Referring to the prior art it is said that due to hydrostatic pressure and the difference in area between the upper and lower seals of some dampers the resilient element is preloaded in compression, necessitating the use of "hard" deformable elements e.g. with an initial spring rate requiring 100,000 lb. for the first $\frac{3}{4}$ inch deflection and a later spring rate requiring another 100,000 lb. for the next $\frac{1}{4}$ inch deflection, but which will still go solid at normal drilling depths due to hydrostatic pressure. Other dampers are said to avoid this by using a floating seal for one end of the spring chamber, so as to equalize the pressure, but in such dampers Mason indicates that inappropriate springs were used.

Mason notes that for many shock absorbing elements the spring rate increases with the load causing the damper to operate at a point where the spring rate is high. Mason's objective is to provide a damper which operates at a position where the spring rate is low at all times. Mason therefore discloses a shock absorber having a low initial spring rate and having a floating seal to equalize pressure and eliminate preload. But since his spring means is only single acting, this requires operation about a mean position in which the spring means is partially compressed, so that the spring rate is higher.

Mason contemplates operating the damper with a static spring force of about 25,000 lb., at which point the damper has a spring rate of 20,000 lb. per inch. This static load on the spring is said to be the difference between 55,000 lb. drilling weight and a 30,000 lb. pump apart force. For operating in shallow wells where the bit weight may be low, to insure some static compression of the spring Mason proposes to reduce the pump apart force by reducing the area of the seal between mandrel and barrel. To that end he provides a lower seal ring of smaller area and vents the annulus between the lower seal ring and the floating seal ring.

Mason further notes (at col. 12, lines 21 et seq) that:

"As may occur in some cases, the area enclosed by the outside diameter of the pressure seal ring times the differential pressure may be in excess of the load to be carried on the bit. In this case the damper would remain pumped open and *would not function* as intended."

To overcome this situation Mason eliminates the static pressure balancing floating seal and under-fills the spring chamber with lubricant so that the static pressure overcomes the pump apart force and compresses the spring enough for it to be operative.

In short, Mason et al disclose a single acting damper intended to operate about a partially compressed static load position thereby to avoid banging against the travel limit stops upon imposition of dynamic loads.

The Drilco Industrial division of Smith International, Inc. manufactures a vibration damper including telescoping members with a shoulder on the mandrel in between two shoulders on the barrel forming upper and lower pockets in which are disposed shaped rubber sleeves to provide variable spring rates. The upper sleeve is effective during normal operating conditions and the lower sleeve is effective when the bit is lightly loaded and the pump apart force exceeds the bit weight causing the damper to be extended rather than contracted in the static condition. The damper is intended especially for water well and other shallow hole drilling wherein the pump apart force is small. The lower sleeve is different from the upper sleeve, whose spring rate increases much less rapidly with deflection. Only one or the other of the rubber sleeves is strained at any one time. The spline-spring chamber is exposed to drilling fluid. This construction is shown in a brochure entitled: bearing the notation "0976 Printed in USA", "Drilco Industrial SHOCK SUB ® (Vibration Dampener)" and in U.S. Pat. No. 4,139,994 issued Feb. 20, 1979 to George Abraitys Alther.

It is stated in the brochure:

"Vertical shock is absorbed by a large elastomeric element in compression. The element material is specially compounded to provide optimum characteristics of load carrying ability, fatigue resistance, resilience and dampening. The element is geometrically shaped to provide uniform "softness" at bit weights from near zero to 30,000 lbs. A second, smaller elastomeric element is provided to cushion reverse loading during severe rebounds or when pulling from the hole."

SUMMARY OF THE INVENTION

According to the invention there is provided a splined resilient tubular telescopic joint especially adapted for drilling under balanced load conditions, i.e. where the drilling weight is substantially equal to the pump apart force. Under such conditions, the spring means is substantially unstressed when the joint is in neutral position, i.e. the position of the joint if the bit were rolling on a flat bottom hole. To provide the desired resilient action upon both rise and fall of the bit from such neutral position, a double acting resilient joint is provided, i.e. one which flexes both upon contraction and extension of the joint, and the resilient joint has a very low spring rate when the joint is in the neutral position and over a considerable range of deflection from the neutral position both upon extension and contraction of the resilient joint. Only as the joint approaches full extension or contraction does the spring rate increase to gradually, then rapidly, bring extension or contraction of the joint to a halt without banging the travel limit stops.

The resilient joint is provided with spring means which has like characteristics upon both extension and contraction of the joint. The spring means may comprise one or more pairs of oppositely directed like single action spring means, but preferably one or more double acting compression springs are employed wherein the same spring means is compressed whether the joint is extended or contracted. In either case, the spring means will have a variable spring rate, the spring rate being low over a wide range of deflection of the damper in both directions from the zero deflection condition and then increasing rapidly as the travel limit of the joint approached, both upon extension and contraction of the damper.

For the spring means, stacks of springs, e.g. elastomer-metal sandwiches or Belleville springs, (conical washers), in series or series parallel disposition, are preferred, since it is easier to achieve the desired variable spring rate with such construction as compared, for example, to a helical spring. For support and protection the spring rings are disposed in an annular chamber between the telescoping members. To prevent binding, the rings are guided by only line contact with one of the telescoping members and are out of contact with the other member.

To reduce wear, the spring chamber, spline, and telescopic guide bearings are sealed from the drilling fluid and lubricated with oil. One end of the chamber is sealed by pressure seal means capable of withstanding the pressure differential between the interior and exterior of the joint. The other end of the chamber is sealed by a floating seal means which moves to a position in which there is no pressure differential across it. This not only allows for volume changes but leads to a balanced load on the spring means since the fluid pressure acting on the damper is therefore effective over the whole area within the pressure seal means.

Magnetic and electrical means are provided to check on the presence and condition of the lubricant and therefore the soundness of the seal means. The seal means both face downwardly to avoid trapping dirt; in other words, the seal means are positioned so that the direction of flow, were any fluid to leak past the seal, would be upward.

According to a prototype modification of the invention, a telescopic joint has a tool joint pin at its lower end and a tool joint box at its upper end. Inner and outer tubes of the joint are splined together. Close fitting sliding surfaces above and below the spline provide bearings to take bending moment. Shoulders formed by the ends of a split coupling in the outer tube are engageable with shoulders on the inner tube to limit travel (extension and contraction) of the telescopic joint. The inner tube is sealed to the outer tube by a sliding high pressure seal comprising two lip type seal rings held against axial motion on the inner tube by barbs which engage grooves in the seal rings. Upper and lower flexible diaphragm low pressure seals protected by skirts seal off two annular spaces between the tubes above and below the high pressure seal. These two spaces are filled with clean pure oil (good insulator). Volume compensators or pressure equalizers (bellows) allow the joint to expand and contract and keep the pressure equal on both sides of the low pressure seals, which merely separate the clean oil from the drilling fluid. The clean oil provides a medium which prevents deterioration of the high pressure seal due to sand, so the seal need not be an elastomer (to absorb sand) and can be made of hard high temperature resistant material. Oil purity can be tested by checking its electrical resistance by applying an ohmmeter across one of two electrodes extending into the two oil spaces and one of the metal inner or outer tubes of the joint. Each electrode extends through a hole in the side of the joint. A ceramic insulator sleeve around the electrode (pin) insulates it from the metal body (inner tube or outer tube). If the oil is dirty (seal has leaked) its resistance will be low, e.g. due to water contaminant from the drilling mud.

The foregoing sealed seal construction is incorporated in a vibration dampener by disposing in the lower oil space a spline and a stack of Belleville springs, alternatingly directed so as to give greater axial deformation for any given load. The springs are mounted to be double acting, e.g. they compress whether the joint is extended or contracted.

The sealed seal construction is incorporated in a hydraulic jar by disposing in the uppper oil space a spline and a dash pot controlled check valve.

The check valve comprises an outer peripherally fluted check valve ring which can substantially close the annulus between a conical outer seat on the inner periphery of the outer tube and a cylindrical inner seat on the outer periphery of the inner tube. The ring is biased toward its outer seat by its own weight, with or without the aid of a light spring. When the joint is fully contracted, as after a downward jar, the inner seat is adjacent the valve ring. When the joint is placed in tension, oil in between the high pressure seat and the valve ring locks the joint against rapid extension so a strong pull can be exerted on the drill string, causing it to stretch. After a while, oil leaks past the valve ring between its inner periphery and the cylindrical seat on the inner tube (a leaky fit) as in a dashpot. When the ring inner periphery moves past the inner seat, oil is suddenly released and the joint extends suddenly as the stretched drill string contracts. This creates a jar as the joint travel stops engage. This jars upwardly on the inner tube to free the drill string connected below the jar from being stuck in the well. If the drill string is then lowered, the joint contracts under the weight and inertia of the drill pipe, the valve ring rising off its conical seal allowing a free fall of the drill string which jars downwardly as the other stop shoulders of the jar engage.

Another advantage of the sealed seat construction described above is that the high pressure seal ring may be made of low gas absorbtivity material (Teflon). Elastomers are subject to bends at high pressure, i.e. gas is slowly absorbed (e.g. methane) and when the tool is removed from the hole the gas suddenly expands and causes blisters. Protecting the seal from drilling mud makes it unnecessary to use elastomers since there is no cutting of the seal due to abrasive drilling fluid. Polytetrafluorethylene (Teflon) is the preferred material for the high pressure seal, since it is stable at high temperature and the fluor-carbons are not subject to bends.

The high pressure seal rings are not bonded to either tube since bonds break down at high temperature. Instead a double lip seal is used; the lips seal to both the inner and outer tubes; in order to insure that lip seals do not leak, metal leaf springs are inserted in the lips.

In order to get sufficient volume compensation, plural bellows can be used around the periphery of the joint and/or spread out axially along the joint.

Somewhere along the length of the tubes forming the telescopic joint there will be filler holes, closed by screw plugs, to fill the sealed spaces with oil.

EVOLUTION OF THE INVENTION

Applicant's conception of a damper especially adapted for balanced load drilling called broadly for a variable spring rate double acting damper, that is, one wherein low spring force resists both contraction and extension of the damper, and higher spring force is effective as the damper approaches its travel limits upon both contraction and extension of the damper.

Double Acting Dampers

Relative to double acting dampers broadly considered, the following United States patents and publications are noted.

U.S. Pat. No. 1,960,688—Archer (1934)
U.S. Pat. No. 2,325,132—Haushalter et al
U.S. Pat. No. 3,033,132—Garrett
U.S. Pat. No. 3,099,918—Garrett
U.S. Pat. No. 2,727,368—Morton (1955)
U.S. Pat. No. 3,122,902—Blair et al
U.S. Pat. No. 3,254,508—Garrett
U.S. Pat. No. 3,323,326—Vertson
U.S. Pat. No. 3,447,340—Garrett (1969)
U.S. Pat. No. 3,503,224—Davidescu
U.S. Pat. No. 3,779,040—Garrett
"Cougar Shock Tool"—Cougar Tool Co. Ltd.—ante c. 1977.

In the foregoing constructions, though the joint is flexible both upon extension and contraction, note needs to made of the positions of the travel limit means, a greater travel in contraction indicating a joint intended to operate with the spring means in compression in the neutral position. For further consideration, the above listed patents are divided into four groups according to the nature of the spring means, as follows:

a. Shear Type.

In the Archer patent there is disclosed a telescopic drill string damper in which a rubber sleeve between the telescoping members apparently is loaded in shear, allowing the rubber to be stressed whether the damper is extended or contracted. A similar construction is shown in the Haushalter et al patent. Neither of these constructions requires a spline, torque being transmitted through the rubber.

Garrett U.S. Pat. No. 3,033,011 shows a vibration damper employing a telescopic joint and an elastomeric axial resilient element which also transmits torque, travel limit stops, guides to take bending moment, and a sliding seal. The damper is double acting in that both extension and contraction place the resilient element in shear. A similar construction adding an emergency clutch to transmit torque in case of failure of the rubber sleeve is shown in Garrett's U.S. Pat. No. 3,099,918.

In the Davidescu patent there is shown a damper employing sleeve type rubber metal sandwiches between the mandrel and barrel. It appears that both extension and contraction of the damper will place the resilient elements in shear.

In Garrett U.S. Pat. No. 3,779,040 there is disclosed a vibration damper to be used between the drill steel and power swivel of a boring machine, employing an elastomer resilient unit.

All of the foregoing shear type dampers would appear to have fairly constant spring rates.

b. Alternate Tension-Compression Type.

Applicant's U.S. Pat. No. 3,254,508 relates to a bellows type vibration damper, the bellows serving to transmit torque, axial force and fluid and being surrounded by a sealed chamber in which is disposed a lubricant separated from the drilling fluid by the bellows and a floating seal. The damper bellows is compressed upon contraction of the joint and placed in tension when the damper is extended.

In applicant's U.S. Pat. No. 3,447,340 there is disclosed a damper similar to that of the aforementioned Garrett U.S. Pat. No. 3,254,508 except that the bellows has helical convolutions. The travel limit stops are positioned so that the damper can both extend and contract, tensioning or compressing the spring, but the permissible extension travel is much less than the contraction allowed.

Although a single spring means is employed in the double acting dampers of the above two patents, the spring action is different upon extension than it is upon contraction of the damper, and in both cases the initial spring rate at zero deflection is apparently of the same order of magnitude as at the travel limits.

c. Differently Positioned Springs Alternately Compressed.

In the Morton patent there is disclosed a vibration damper to be used in propeller shafts. The damper comprises telescoping members with a rubber sleeve in the annulus therebetween and bonded thereto to transmit torque. Shoulders on the members engage the rubber sleeve axially so as to transmit thrust. The arrangement appears to be such as to axially compress one part of the rubber sleeve upon thrust in one direction corresponding to contraction of the damper and to axially compress another part of the rubber sleeve upon extension of the damper (e.g. during reversal of the propeller), and it appears that tension is alternately applied to such parts of the rubber sleeve as are not compressed. It is further stated that due to the differing axial thicknesses of the sleeve there will be two natural periods of torsional vibration so that torsional vibrations will tend to interfere and cancel out.

In the Vertson patent there is disclosed a telescopic damper including helical shoulders on the barrel and mandrel with two joined helical rubber elements therebetween. Apparently one element is compressed while the other is unloaded, causing rubber to flow from one element to the other, regardless of whether the damper is extended or contracted.

The Cougar leaflet appears to disclose a telescopic tool employing two rubber sleeves as resilient elements, which, as appears from later editions of the leaflet, act alternately upon extension and contraction of the joint rather than merely function as in U.S. Pat. No. 3,660,990—Zerb, wherein it is said that a rubber seal in series with the main resilient sleeve also acts to damp shocks.

It does not appear that any of the rubber elements of the constructions of the foregoing group of patents is designed to have a variable spring rate with an extremely low spring rate over a range of deflection in both directions coupled with a very high spring rate at both travel limits.

Variable Spring Rate Dampers

Applicant's first conception of a variable spring rate resilient unit for balanced load drilling contemplated the possible use of felted steel wire ("steelwool") annular pads for the spring elements, such elements filling the annular chamber between mandrel and case and engaging the side walls thereof. Somewhat similar elements are shown in U.S. Pat. Nos. 3,383,126—Salvatori et al and 3,406,537—Falkner, Jr. Salvatori et al shows a vibration damper employing an upper sliding lip seal and a lower floating seal, with a spline and a resilient element in the chamber therebetween. A similar construction is shown in the Falkner, Jr. patent. Falkner, Jr. fills his chamber with oil.

Double Acting Dampers With Single Spring

When applicant first conceived of his invention of a variable spring rate double acting damper for balanced load drilling, he requested one of the engineers in his department to draw up an embodiment. The engineer chose as spring means for the double acting damper, a double acting compression spring construction, thereby to compress the same stack of wire pads upon both extension and contraction of the damper. The wire pads were disposed between shoulders on the barrel and mandrel, with spacers allowing the shoulders to lie in different planes. Such a double acting spring construction is employed in the preferred embodiment of the double acting damper shown herein. Relevant to such construction are the following publications: U.S. Pat. No. 3,381,780—Stachowiak (1968) and USSR inventor's certificate No. 1,279,335—Shprenk (1970), both of which apparently show such shoulder disposition, and Shprenk appearing to show such spacers.

The Stachowiak patent relates to a formation testing shock absorber. The shock absorbing element includes an elastomer sleeve axially compressible and radially expansible to pump a liquid out of dash-pot space. A solid floating piston for pressure and volume compensation is employed. The damper is double acting, the mandrel and barrel members each having two axially spaced apart shoulders which extend less than half way across the annulus between the members, so that the rubber sleeve captured in the annulus between the shoulders is compressed axially upon both extension and contraction of the joint. The resiliency of the sleeve is said to return the tool to full extended position. When the elastomer sleeve is compressed, it rubs on the surrounding case. Though the sleeve is shaped, the effect is said to cause increasing friction as deflection increases, without mention of any spring action. At the same time, the deformation of the sleeve constricts the dash pot action. A constant force versus deflection is said to be achieved. This corresponds to a constant spring rate of zero.

The Shprenk et al publcation, entitled "Superbit Shock Absorber", appears to disclose a vibration damper employing barrel and mandrel members with elastic rings gripped in parallel between the members and engageable by axially spaced shoulder means on the mandrel and also by axially spaced shoulder means on the barrel, to strain the elastic elements whether the damper is extended or contracted, spacers allowing the shoulders to be non-coplanar. However, the elastic elements are strained, apparently, by relative axial movement of their inner and outer peripheries relative to a bridging washer embedded in the elastic elements rather than by axial approach of their end faces.

In neither the Stackowiak nor the Shprenk publications is there any discussion of the pump apart force nor balanced load drilling nor any disclosure of using a plurality of rings in series to achieve high flexibility, nor paralleled groups of series stacked rings to reduce stress on individual rings.

Rubber Sandwich Springs

In the evolution of his invention, applicant later conceived of a spring means including a plurality of elastomer rings of oval cross-section sandwiched between dished metal washers. A search relative to this type of spring revealed certain prior United States patents as follows. U.S. Pat. Nos.

2,733,915—Dentler (1956)
2,930,491
2,946,462—Danielson (1960)
2,982,536—Kordes (1961)
3,330,519—Thorn (1967)
3,480,268—Fishbaugh (1969)
3,493,221—Mozdzanowski (1970)
3,677,535—Beck (1972)
3,814,411—Aarons et al (1974)
3,997,151—Leingang (1976)

Applicant has since conceived of an improved spring means of this type providing for paralleling several groups of such rubber sandwiches, as will be described in more detail hereinafter.

Other drill string resilient units employing rubber sandwich spring means are known. For example, there is disclosed in British Pat. No. 220470 (1924)—Reichwald, a telescopic jar with torque transmission means, useful for well drilling, wherein the jar is cushioned on the lifting or jar extension stroke by a plurality of rubber rings sandwiched between flanged metal rings. The flanges, normally out of contact, limit compression of the rubber. The rubber rings are spaced radially from both the inner and outer telescopic members and the flanges of the metal rings surround the inner member.

A tubular telescopic joint employing a spline, sliding seal, and resilient means, to form a vibration damper is shown by U.S. Pat. No. 3,301,009—Coulter, Jr. (1967). In the Coulter construction the resilient means includes a plurality of hexagon cross-section elastomer rings with single flat washers interposed between each adjacent pair of elastomer rings. The resilient means is single acting. The sides of the rings rub against the mandrel of the telescopic joint. A form of inverted floating seal is shown at the upper end of the spring chamber, but the spring chamber is not sealed at its lower end.

Belleville Springs

In the further evolution of his invention of a resilient unit for balanced load drilling, applicant considered the employment of Belleville springs disposed in series-parallel stacks. At this stage, applicant was particularly concerned with protecting the seals employed for the lubricated chamber in which the springs are mounted.

The use of plural telescopic joints, one for each leg of a three cone roller bit is shown in U.S. Pat. No. 2,815,928—Bodine, the joints each including a vibration damper in the form (FIG. 6) of a stack of dished washers alternately disposed. Axially spaced cylindrical bushings provide vertical motion supports. Interengaging means on the bit legs and bit body limit relative rotation. In a modification (FIG. 9), a single spline telescopic joint is used and the resilient member is in the form of a long steel sleeve. The spline is in a sealed chamber filled with grease; the seals for the chamber are sliding seals. The steel sleeve is also sealed at both ends and extends above and below the spline. Volume compensating ports at one end expose the upper spline seal to well fluid and the lower spline seal is exposed thereto at the lower end of the tube.

In U.S. Pat. No. 3,539,026—Sutliff et al, is disclosed a fishing tool energizer comprising a splined telescopic joint with groups of paralleled Belleville springs stacked in series to provide the resilient unit. To vary the spring force, more or fewer springs can be parallel in each group.

A vibration damper employing Belleville springs for the resilient element is shown in U.S. Pat. No. 3,871,193—Young. The resilient element and spline are in a lubricating oil chamber formed by upper and lower sliding seals between telescoping inner and outer members. The resilient element includes a plurality of spring means of different spring rates stacked in series. When the lighter spring means reach their limit of travel, the heavier spring means are left, presenting a higher spring rate. In two embodiments, groups of Belleville springs are employed stacked in series with varying members of springs paralleled in each group. In another embodiment coil springs of differing cross-sections are stacked in series.

U.S. Pat. No. 3,898,815—Young discloses a sealed, lubricated telescopic tool including ball spline means and disc spring means.

A vibration damper made in Canada by Smith International Canada, includes a telescopic joint, spline, a stack of several groups of Belleville springs with the groups in series and the springs in parallel in each group, seals above and below the spline providing a chamber for lubricant, a three inch travel from no load to 60,000 lb. and a spring rate of 20,000 lb/inch.

None of the above constructions appears to be concerned with balanced load drilling.

Most recently, applicant asked J. B. Hiebel, one of the men in his department, to further the development of his invention of a double acting damper for balanced load drilling. This further development resulted in a damper construction employing roller Belleville springs, shown as the preferred embodiment of applicant's damper for balanced load drilling. A separate application by J. B. Hiebel on a damper employing roller Belleville springs is contemplated.

Roller Belleville springs are a species of variable moment Belleville springs, the latter being disclosed in U.S. Pat. No. 2,675,225—Migny. In FIG. 3, it is shown that such springs may be stacked in series-parallel, but the parallel springs are not all of the variable moment type, including simple dished washers in the middle of each parallel group.

SEALED LUBRICATED SPRING-SPLINE-BEARING CHAMBER

As noted previously, part of applicant's overall concept of a damper for balanced load drilling included a sealed and lubricated spring-spline-bearing chamber. In addition to the patents previously discussed, a number of other patents may be mentioned relative to the employment of a sealed lubricated spring-spline-bearing chamber, in a tubular, axially resilient telescopic joint for well drilling, as follows. U.S. Pat. Nos.

2,025,100—Gill et al
2,240,519—Reed (three lobed spline)
3,323,327—Leathers et al
3,345,832—Bottoms
3,581,834—Kellner and Garrett

BRIEF DESCRIPTION OF THE DRAWINGS

For a description of a preferred embodiment of the invention, reference will now be made to the accompanying scale drawings, the elevational and cross-sectional views showing that the parts are made of metal, e.g. steel, except as otherwise indicated, e.g. the seals are preferably made of Teflon or an oil and water resistant elastomeric material, and in a modification elastomer-metal sandwich spring elements are employed.

FIG. 1A is a detail to a larger scale, showing the electrical test probe of the damper;

FIGS. 2A'' and 2B'' together hereinafter referred to as FIG. 2'', are fragmentary sectional views similar to FIG. 2' showing the lower end of the damper in the closed or contracted position;

FIGS. 2' and 2'' are drawn with a common center line for easy comparison and may be referred to together as FIG. 2;

FIGS. 3A", 3B" and 3C", together hereinafter referred to as FIG. 3", are fragmentary sectional views, similar to FIG. 3', showing the medial portion of the damper in the closed or contracted position.

FIGS. 4A" and 4B", together hereinafter referred to as FIG. 4", are views similar to FIGS. 4A' and 4B', showing the upper end of the damper in the closed or contracted position;

FIGS. 5, 5A and 6, are respectively sections taken at planes 5—5, 5A—5A and 6—6 of FIGS. 3 and 2';

FIG. 8, 9 and 9A are graphs; and

FIG. 11 is an elevation, partly in section, showing a damper according to a prototype modification of the invention assembled in the lower end of a drill string, with the spring means in the neutral or unloaded position;

FIGS. 12–16 are fragmentary half sections of the damper shown in FIG. 11, being to a larger scale and taken at the levels 12—12, 13—13, 14—14, 15—15, and 16—16 indicated in FIG. 1, thus together covering the full length of the damper;

FIGS. 19–21 are fragmentary sectional views analagous to FIG. 12–16 but together showing a modification of the invention of FIG. 11 providing a hydraulic jar;

FIG. 23 is a fragmentary section showing a modification of a part of the hydraulic jar shown in FIGS. 19–22.

DESCRIPTION OF PREFERRED EMBODIMENTS

Damper

Figure 1:
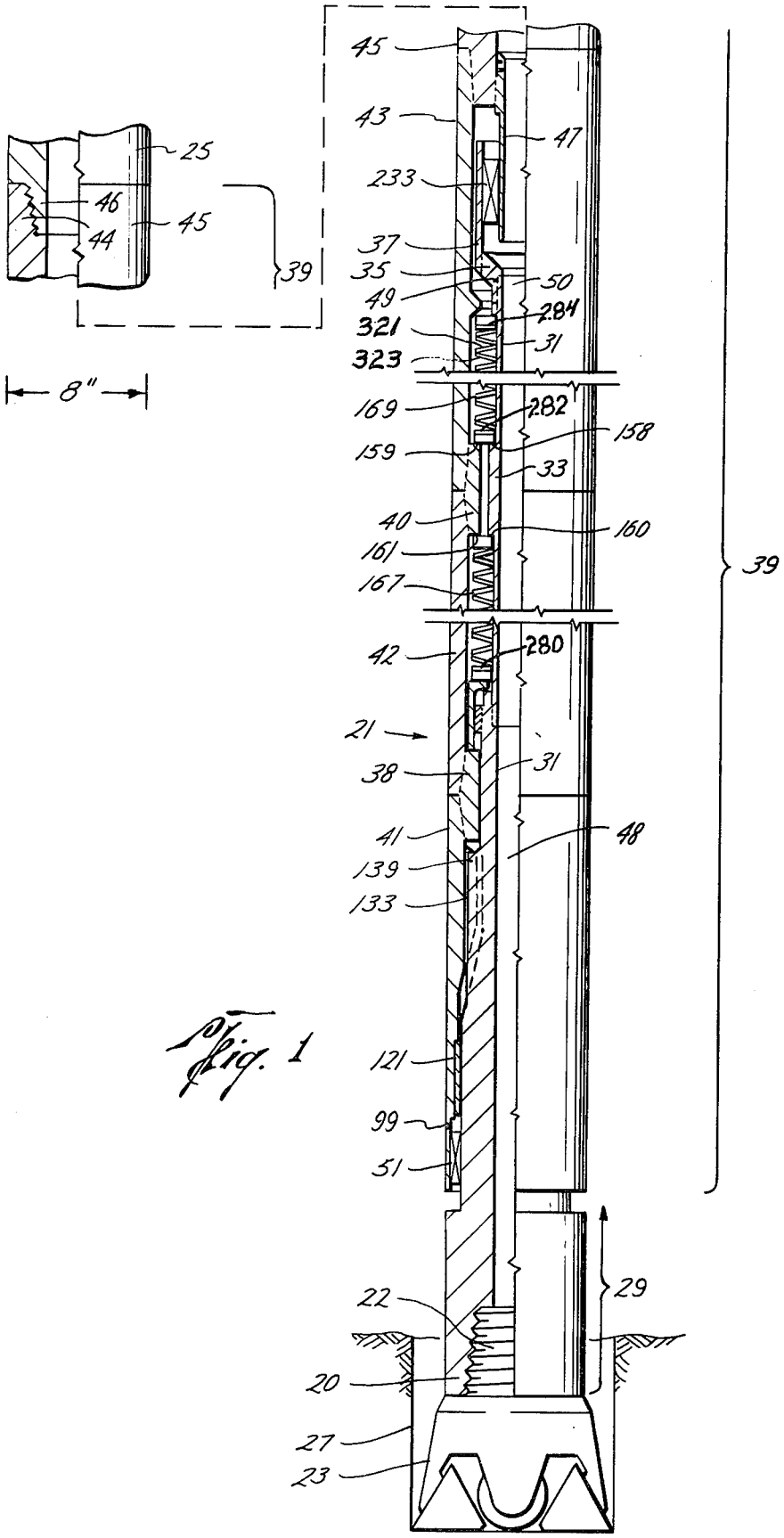
FIG. 1 is an elevation, partly in section, showing a damper according to the invention assembled in the lower end of a drill string, with the spring means in the neutral or unloaded position.

Referring now to the drawings and in particular to FIG. 1, there is shown a damper 21 connected at its lower end to a three cone drill bit 23 and at its upper end to another lower drill string member 25 such as a stabilizer or drill collar. Although the drawing shows the damper directly above the bit, it may be employed at other places in the drill string, preferably however where most of the weight slacked off in the drill string is above the damper. The apparatus is shown in a well bore 27 being drilled by bit 23 by the rotary system of drilling. The damper includes a tubular mandrel identified generally by reference number 29. The mandrel comprises a lower seal and bearing and spline portion 31, a medial spring portion 33, a cross over sub portion 35, and an upper compensator portion 37. Mandrel portions 31, 33, and 35 are connected by rotary shouldered taper threaded connections, such connections being more fully described in U.S. Pat. No. 3,754,609—Garrett. Mandrel portion 37 is shrink fitted to mandrel portion 35.

Mandrel 29 works telescopically within and about a tubular barrel indicated generally by reference character 39. The barrel includes a lower seal and bearing and spline portion 41, a medial spring portion 43, an upper cross over sub 45, and a depending compensator portion 47. Barrel portions 41, 43, 45 are connected together by rotary shouldered connections as above referenced. Barrel portions 45, 47 are connected together by a taper thread and are sealed by an O ring 49.

The connections between the damper and drill bit and between damper and the upper part of the drill string are also rotary shouldered connections. Such connections each comprise a pin and box connector and either type of connector may be provided at each end of the damper, depending on what type of use is to be made of the damper. As shown, a box connector 40 is provided at the lower end of the damper for connection with a drill bit pin 42, and at the upper end of the damper there is a box connector 44 for connection with a pin 46 on lower drill string member 25.

Passage means through the damper for conveying drilling fluid from lower drill string member 25 to drill bit 23 include central passages 48, 50 through tubular mandrel portions 31, 33.

Referring now to FIG. 2, there is shown most of the lower portion of the damper, forming the seal, bearing and spline part thereof. This includes portions 31, 41 of the mandrel and barrel.

Pressure Seal

At the lowermost part of the damper there is seal means 51 disposed between the barrel and mandrel portions 31, 44. Seal means 51 comprises a plurality of double lip seal rings 53, 55, 57, 59. Seal rings 53, 55 face upwardly; seal rings 57, 59 face downwardly. The seal rings are preferably made of Teflon or other low friction coefficient, high temperature resistant, flexible, resilient, sealing material. The lips of the seal rings are preloaded to move away from each other by corrosion resistant metal springs such as those indicated at 52, 54, 56, 58.

Metal wedge rings 61, 63, 65, 67 also hold apart the lips of the seal rings to assist them in moving into sealing engagement with low friction coefficient hard metal finished surface 68 at the cylindrical outer periphery of mandrel portion 31 and the finished surfaces 70, 72, 74 at the cylindrical inner periphery of barrel portion 41 and the cylindrical upper and lower inner peripheral portions of spacer ring 76. Weep holes 60, 63, 64, 66 equalize fluid pressure on opposite sides of the rings. The wedge rings have tongues extending to the bottoms of the annular spaces between the seal ring lips to transmit force through the bottoms of the seal rings when axial force is imposed on the wedge rings. Although as noted above, the wedge rings spread apart the lips of the seal rings, their function of transmitting force through the bottoms of the rings being their primary function, thus permitting stacking of the seal rings, as in the case of rings 53, 55. In addition, the flat surface of the uppermost wedge ring 61 facilitates retention of the seal rings in the barrel underneath steel retainer ring 69. Ring 69 is beveled and rests against bevel shoulder 71 in the barrel.

The force of the fluid pressure in the damper acting down on seal rings 53, 55 is transferred by end ring 73 through support ring 76 to end ring 77 and thence to snap ring 79, received in annular groove 81 in the lower end of the barrel.

Support ring 76 is sealed to the barrel by O rings 82, 83 received in annular groove around the support ring. The O rings are in slight compression between the bottoms of the grooves and barrel surface 85. Support ring 76 is held fixed in the barrel between end rings 73, 77, which are captured between snap ring 79 and a shoulder 87 at the juncture of upper seal surface 70 and larger diameter lower seal surface 85. Therefore O rings are suitable for the nonsliding seal between the barrel and support ring 76. This is in contrast to the seals effected by seal rings 53, 55, 57, 59 with the mandrel, which are axially sliding seals.

Support ring 76 not only transfers load from the upper seal rings to snap ring 81 but also provides a cartridge independently supporting seal rings 53, 55 so that load is not transferred from one through the other as in the case of the uppermost seal rings 53, 55, thereby insuring that the lip seal action of each ring remains unimpaired. A similar cartridge construction could be used for the upper two seal rings if desired. Or if preferred, the lower seal rings 57, 59 could be stacked with only a wedge ring in between as in the case of the upper seal rings.

The lower seal rings 57, 59 seal primarily against upwardly directed fluid pressure from the fluid outside the damper. The force of the pressure is transferred to shoulder 87 through end ring 73 in the case of seal 57 and through support ring 76 and end ring 73 in the case of seal ring 59. No force of pressure fluid is intended to be transferred from end ring 77 to wedge ring 66, nor from support ring 76 to wedge ring 65.

Test Probe

As will appear more clearly hereinafter, although seal means 51 seals against the pressure of fluid both in the well bore outside the damper and in the drill string connected to the damper, seal means 51 is exposed to drilling fluid only on its lower side. Above seal means 51 in the space between the barrel and mandrel there is a clean lubricating oil 91 extending all the way up to the compensator portions of the barrel and mandrel. Within this clean fluid work the spline and resilient means later to be described. It is important for the user to know if any of the damper seals has failed. If such failure causes an influx of drilling fluid, the lubricating fluid will become contaminated by the drilling fluid, e.g. with water.

Figure 2A:
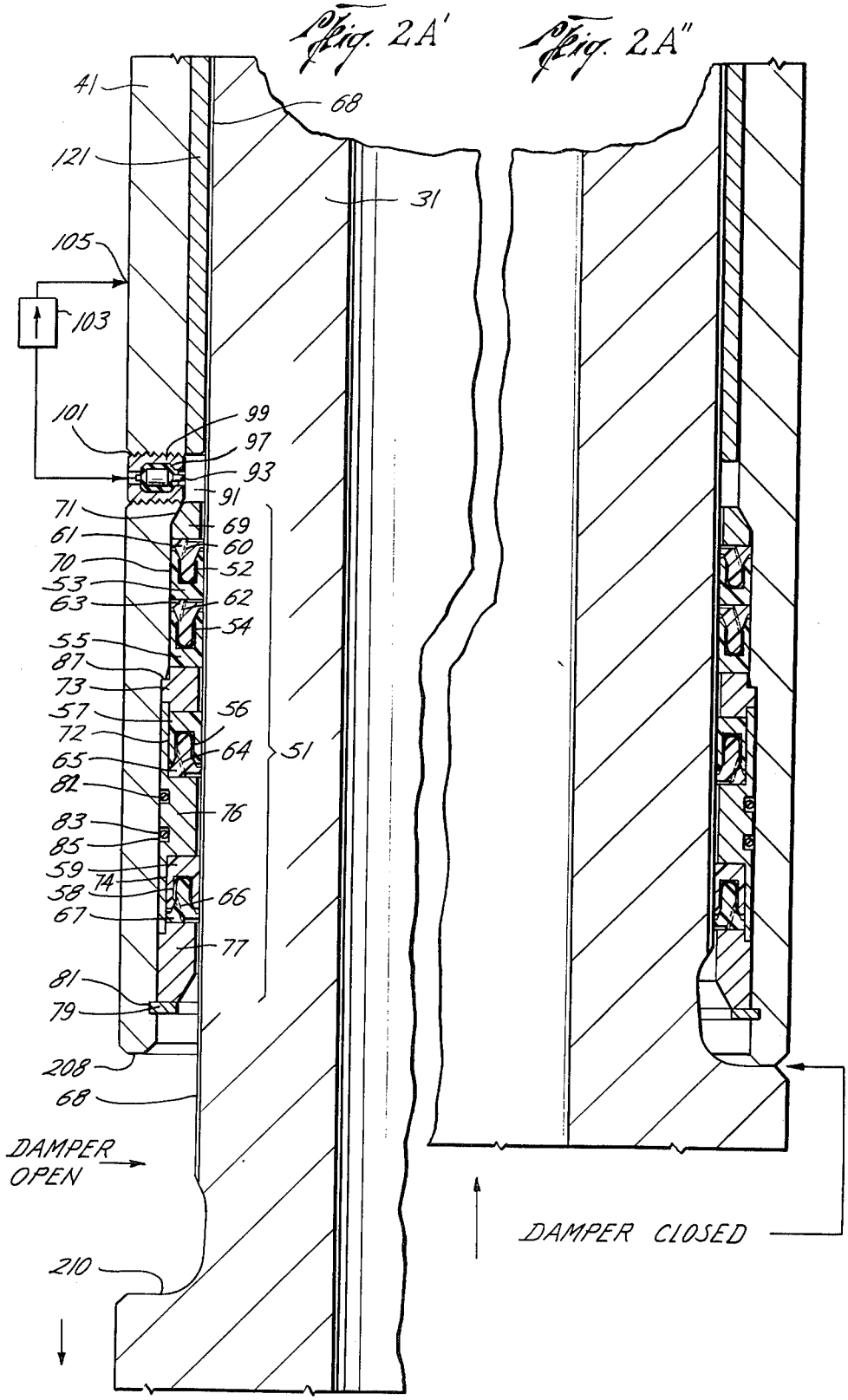
FIGS. 2A and 2B, together hereinafter referred to as FIG. 2', are fragmentary sectional views to a larger scale showing the pressure seal, bearing and spline at the lower end of the damper, with the damper in the open or extended position.
Figure 2B:
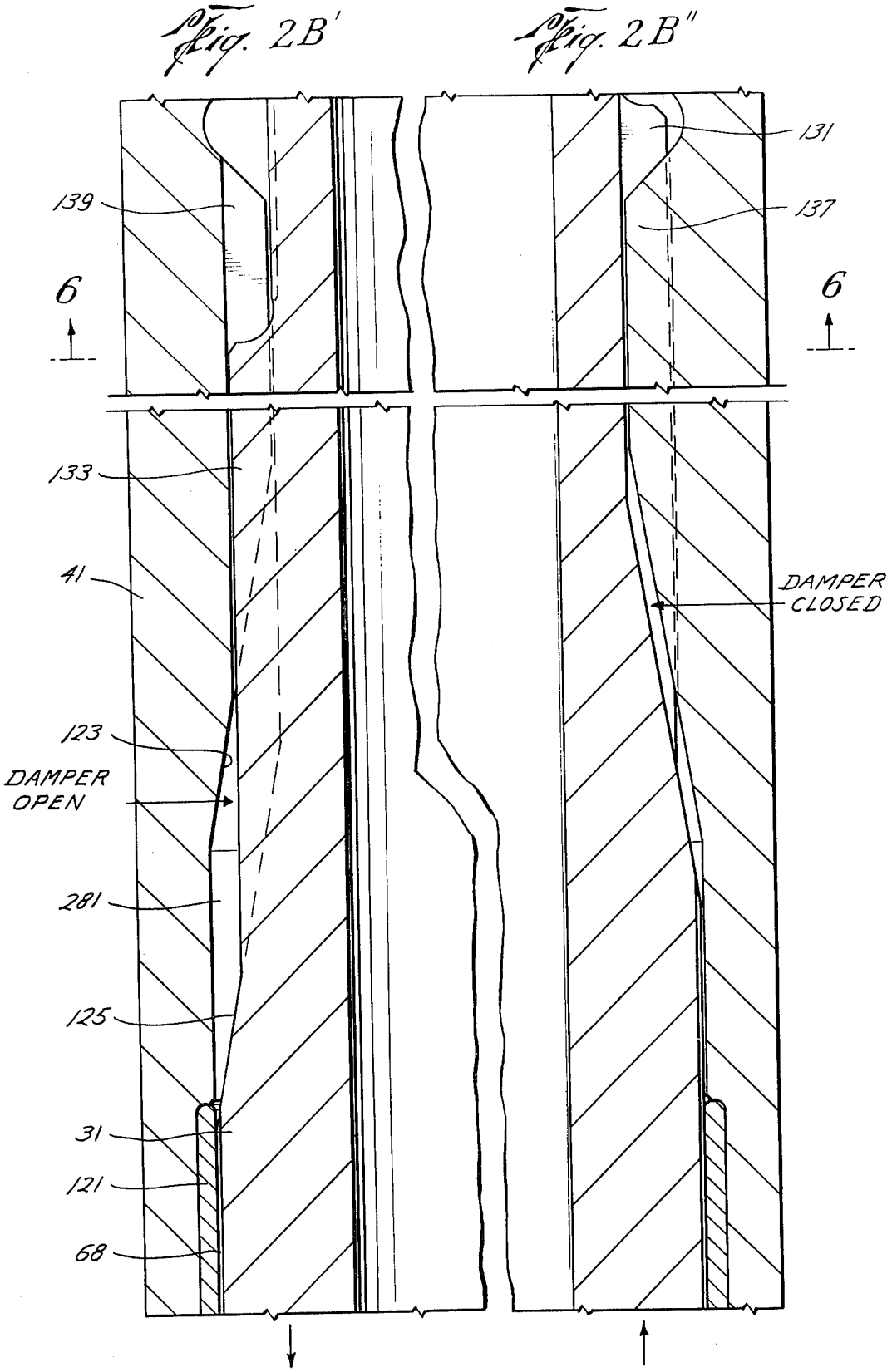

Referring now particularly to FIGS. 1, 1A, and 2A', to detect such a change there is provided in the barrel just above lower seal means 51 a test probe comprising an electrically conductive (metal e.g. brass) electrode 93 extending through the barrel wall. The electrode is surrounded on its outer periphery by and bonded and sealed to electrically insulating sleeve 97 which in turn is mounted in and bonded and sealed to screw plug 99 which is the closure for a lubricant injection and drainage port provided by threaded hole 101 in the barrel wall. The plug is screwed into the port. To prevent the electrode from moving axially under the pressure differential between the interior and exterior of the barrel, the electrode is made of larger diameter at its mid portion than at its ends, leaving tapered shoulders 98, 100 adjacent each end. An annular recess in the screw plug is shaped correlative to the exterior of the electrode forming shoulders at each and of the recess facing toward the shoulders on the electrode. The insulation sleeve is captured at each end between the plug and electrode shoulders and resists relative motion of the electrode and plug. The outer diameter of the mid portion of the electrode is too big to pass through the recess in the plug at the outer end thereof. A material suitable for the insulation sleeve is one which can withstand pressure differential and well fluids such as a plastics material, e.g. epoxy. At its outer end, the recess in plug 99 is formed as a wrench socket 102 to facilitate assembly and disassembly.

By connecting an ohmmeter 103 between the outer end of the electrode and a point such as 105 on the exterior of the barrel, the electrical resistance of the oil 91 can be measured to determine its character, i.e. whether or not it has become contaminated. If so, the damper seals and lubricant need to be checked for replacement and then replaced to the extent required.

It may be noted that whereas the lubricating oil has a high resistivity, most drilling fluids have a low resistivity. Furthermore, the drilling fluid will usually be denser than the oil and will sink to the bottom of the space normally occupied by the oil. That is why the test probe is placed at the lowermost part of such space, just above lower seal means 51. At that point, the test probe will contact any such drilling fluid and the resistance test will show a low resistance path through such drilling fluid.

Lower Bearing Means

Still referring to FIG. 2, above plug 99, the interior of barrel portion 41 is provided with a replaceable bushing or liner 121 made of a wear resisting, low friction coefficient, corrosion resistant bearing material compatible with hard facing material 68 on mandrel 31. For example, liner 121 may be made of beryllium copper or aluminum bronze or the equivalent. The bushing has a smooth cylindrical inner surface which cooperates with a continuation of surface 68 on the exterior of the mandrel to provide bearing means. The bearing means transmits bending moment between mandrel and barrel while providing for relative axial motion therebetween. To provide maximum area for taking bending moment, flutes 147 are made deeper than they are wide.

Spline

Above the bearing means just described, the wall of barrel portion 41 thickens by a reduction in its inner diameter, and there is a correlative thinning of the wall of mandrel portion 31 by a reduction in its outer diameter. Conical surfaces 123, 125 are formed where these transitions occur.

Figure 6:
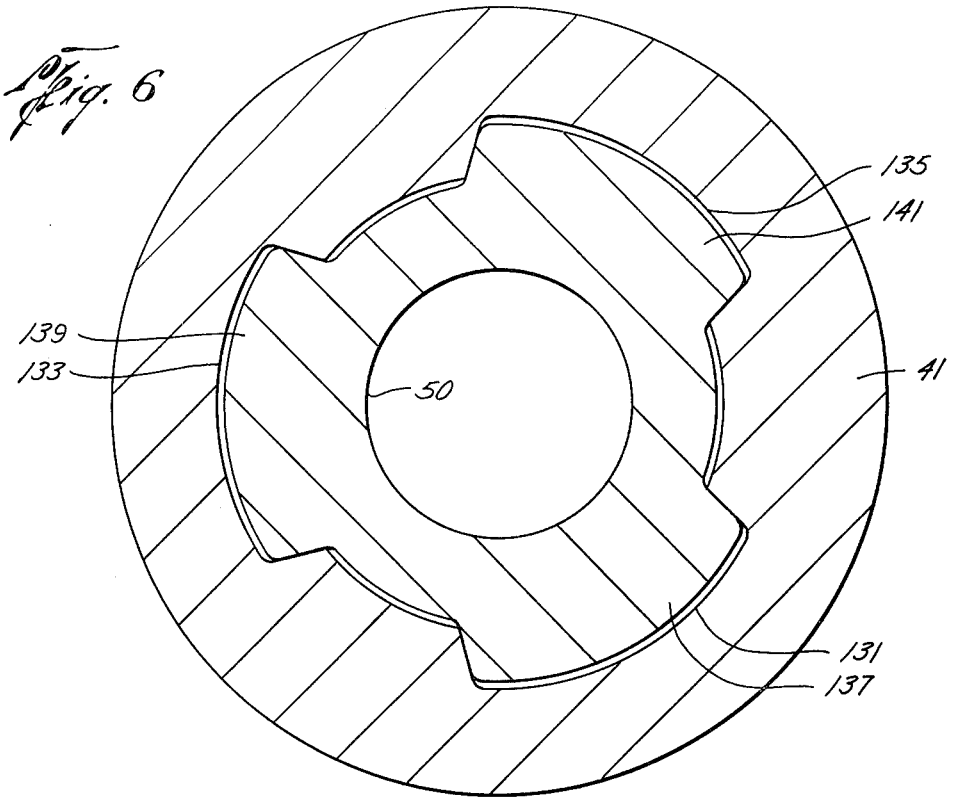

Referring now also to FIG. 6, the interior of the thick walled part of barrel portion 41 is fluted parallel to the barrel axis, forming three vertical grooves 131, 133, 135. The mandrel at this level is provided with three splines 137, 139, 141 which fit into the grooves and cooperate therewith to provide spline means for transmitting torque between the barrel and mandrel while providing for relative axial motion. While a spline can be made to transmit bending moment, e.g. by having the spline bottom in the grooves, the spline means here disclosed is intended primarily for transmission of torque through the side walls of the splines and grooves, the walls having large radial components. However some transmission of bending moment will also be provided by the spline means due to the circumferential components of the side walls of the splines and grooves. Each spline side wall may, for example, make an angle of e.g. 15° to 45° with the radial plane therethrough, FIG. 6 showing a representative desirable angle.

Upper Bearing Means

Above the spline, just described, the inner periphery 143 of buried pin 38 is in sliding contact with the outer periphery 145 of mandrel portion 31, thus providing an upper guide bearing. The upper and lower guide bearings, being spaced apart axially, can take considerable bending moment without being overloaded. The outer periphery of mandrel 31 is fluted at 147, providing fluid passages for lubricating oil 91, as will be explained in more detail hereinafter.

Resilient Means

Figure 3A:
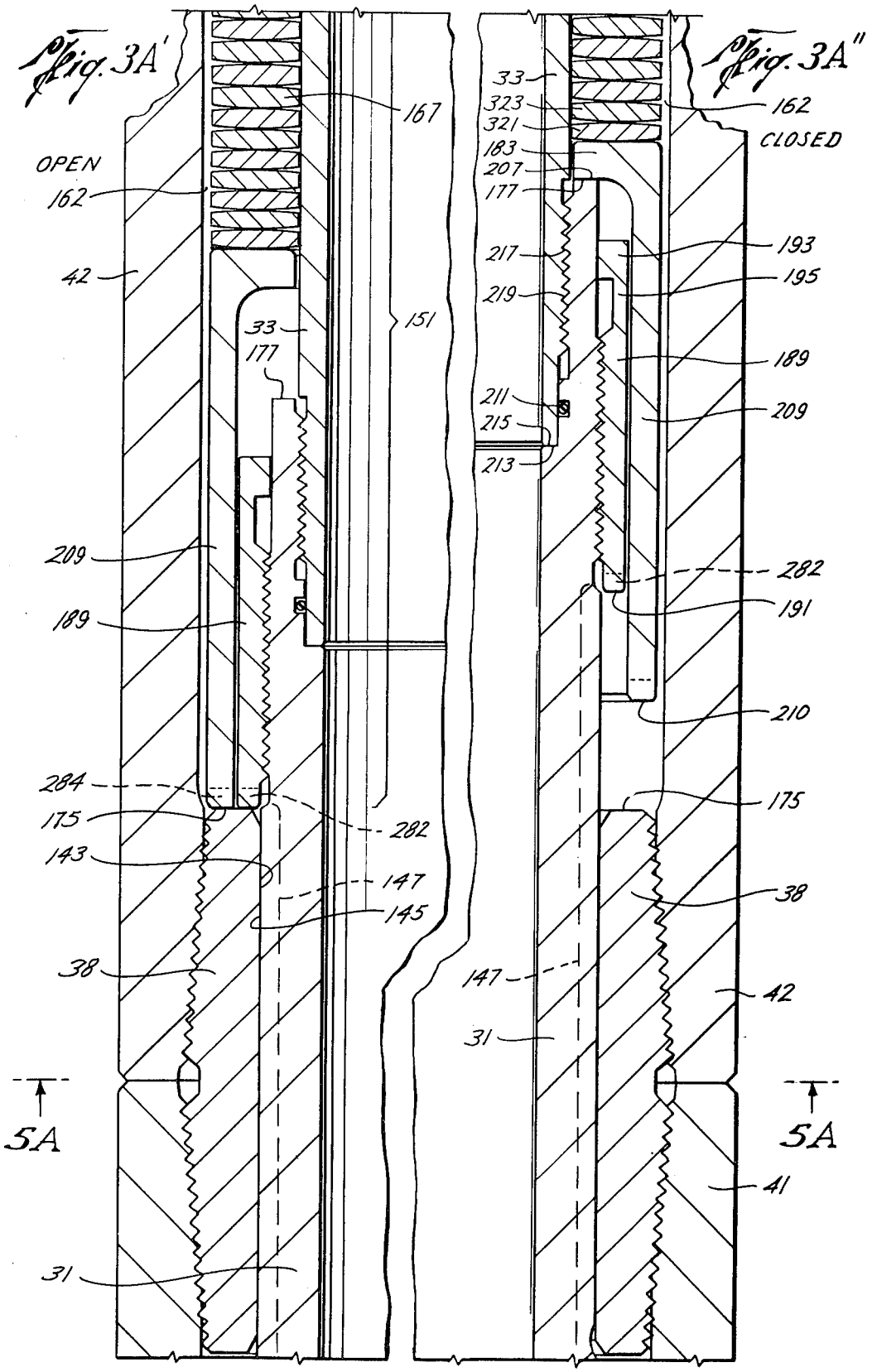
FIGS. 3A', 3B' and 3C', together hereinafter referred to as FIG. 3', are fragmentary sectional views, also to a larger scale than FIG. 1, showing the resilient unit at the medial portion of the damper in its open or extended position.
Figure 3B:
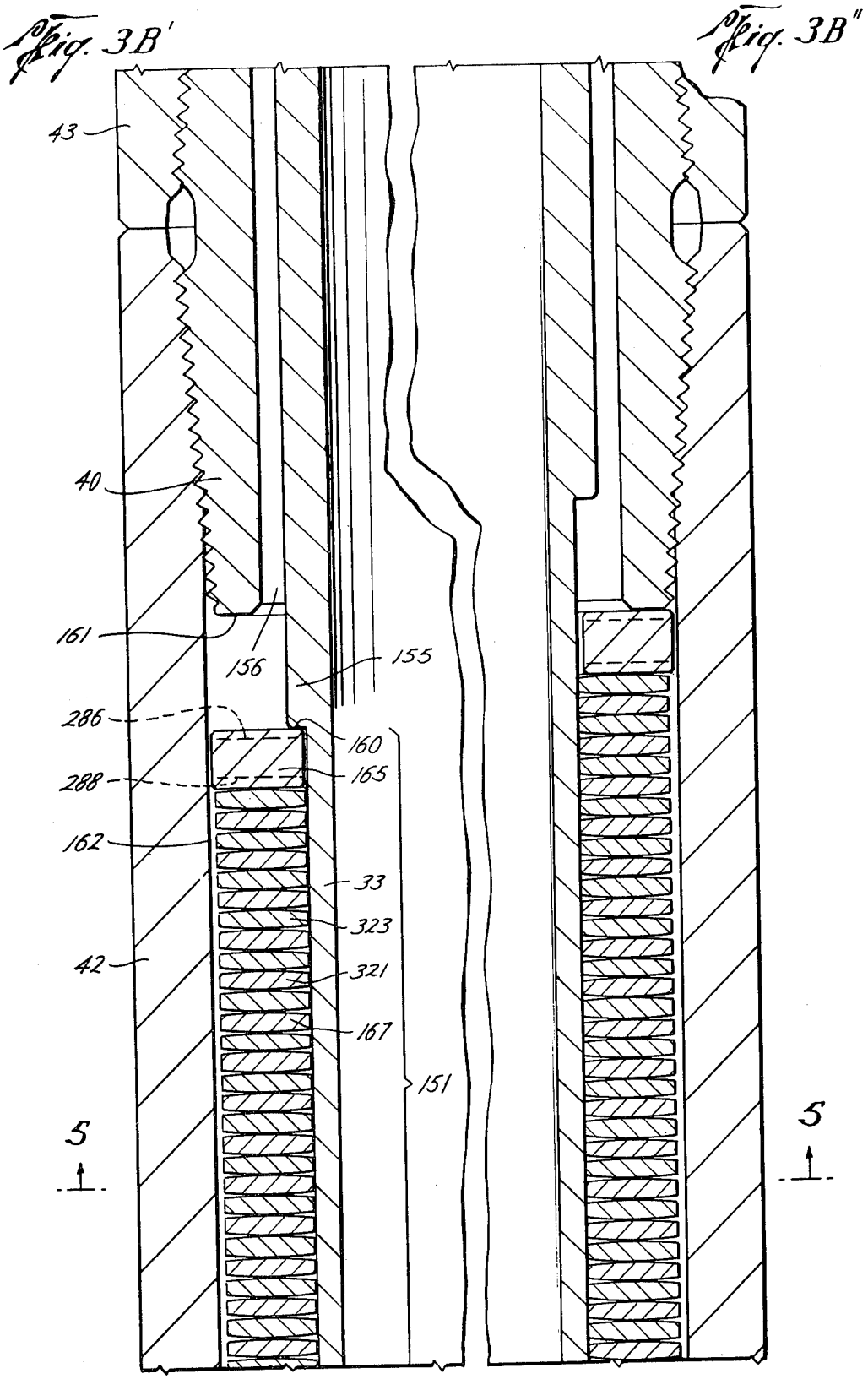
FIGS. 3' and 3" are drawn with a common center line for easy comparison, and these figures taken together may be hereinafter referred to as FIG. 3.

Referring now to FIG. 3, there is shown the medial portion of the damper including the resilient means thereof comprising mandrel portion 33 and barrel portions 42, 43 with spring means 151, 153 therebetween. Mandrel portion 33 has an outturned flange 155 (FIG. 3B′, 3C′) therearound, and buried pin 40 between barrel portions 42, 43 forms in effect an inturned flange within the barrel. These flanges provide upwardly facing annular shoulders 158, 159 and downwardly facing annular shoulders 160, 161. These shoulders define the inner ends of annular pockets 162, 163 between mandrel portion 33 and barrel portions 42, 43. At the inner ends of these pockets are pressure rings 164, 165 engaged respectively with the ends of spring stacks 167, 169 and engageable with shoulders 158–161.

The upper end of pocket 163 is defined by annular shoulder 171 on barrel portion 43 and annular shoulder 173 provided by the lower end of mandrel portion 35. Pressure ring 174 is engaged with the upper end of spring stack 169 and is engageable with shoulders 171, 173.

The lower end of pocket 162 is defined by annular shoulder 175 provided by the upper end of buried pin 38 connecting barrel portions 41, 42, and annular shoulder 177 formed by the upper end of mandrel portion 31. Pressure ring 183 is engaged with the lower end of spring stack 167 and is engageable with shoulders 175 and 177.

It will be apparent that for each spring means 151, 153 the mandrel is provided with upper and lower shoulders and the barrel is provided with upper and lower shoulders, and that since the mandrel and barrel shoulders do not overlap, they can pass each other whichever way the barrel and mandrel are moved axially relative to each other. Regardless of whether the damper is contracted or extended, pairs of mandrel and barrel shoulders will engage the pressure rings to cause the spring means to be compressed axially. Such action is indicated in the left and right hand halves of FIG. 3.

Neutral Position

Referring now to FIG. 1, the damper is shown in the unextended, uncontracted, or neutral position in which the spring means are of maximum length. In the neutral position, the shoulders 158, 160 on the mandrel flange 155 (FIG. 3B′, 3C′) are co-level or in alignment with shoulders 159, 161 on barrel pin 46. At the upper end of spring means 153 (referring to FIG. 3C′ and 3C″ for reference numbers but not for position), in the neutral position pressure ring 174 is engaged both with mandrel shoulder 173 and barrel shoulder 171. Similarly (referring to FIGS. 3A′ and 3A″ for reference numbers but not for position), in the neutral position pressure ring 183 is engaged both with mandrel shoulder 177 and barrel shoulder 175.

Travel Limits

A nut 189 is screwed onto a straight thread on the exterior of the upper end of mandrel portion 31. Nut 189 provides shoulder 191 at its lower end to engage barrel shoulder 175, forming therewith stop means limiting extension of the damper. Nut 189 is provided with a collar 193 which makes an interference (shrink) fit with the uppermost part of mandrel portion 31. A thin section 195 between collar 193 and the body of nut 189 facilitates sawing off the collar if the nut needs to be removed.

Pressure ring 183 is provided with an engageable surface 207 to engage shoulder 177 and an annular tongue 209 whose lower end 210 is adapted to engage shoulder 175. Tongue 209 spans nut 189 and the threaded connection between mandrel portions 31 and 33. Although the latter connection is a rotary shouldered connection as previously mentioned, it is also provided with an O ring seal 211 in case there is difficulty in applying adequate make up torque to the connection to effect a seal at shoulders 213, 215. Screw threads 217, 219 are straight (untapered) threads to facilitate make up.

The L-shaped cross-section of pressure ring 183, which provides tongue 209, permits shoulders 175 and 177 to be in different planes, i.e. non-coplanar, as occurs, e.g. because of the presence of nut 179.

Means limiting contraction of the damper is provided by stop shoulder 208 (FIG. 2A′) on the lower end of the barrel and stop shoulder 210 on the lower part of the mandrel. It will be seen that the possible contraction of the damper from the neutral position equals the possible extension from the neutral position. However they could be made unequal if desired.

Pressure-Volume Compensation Means

Figure 3C:
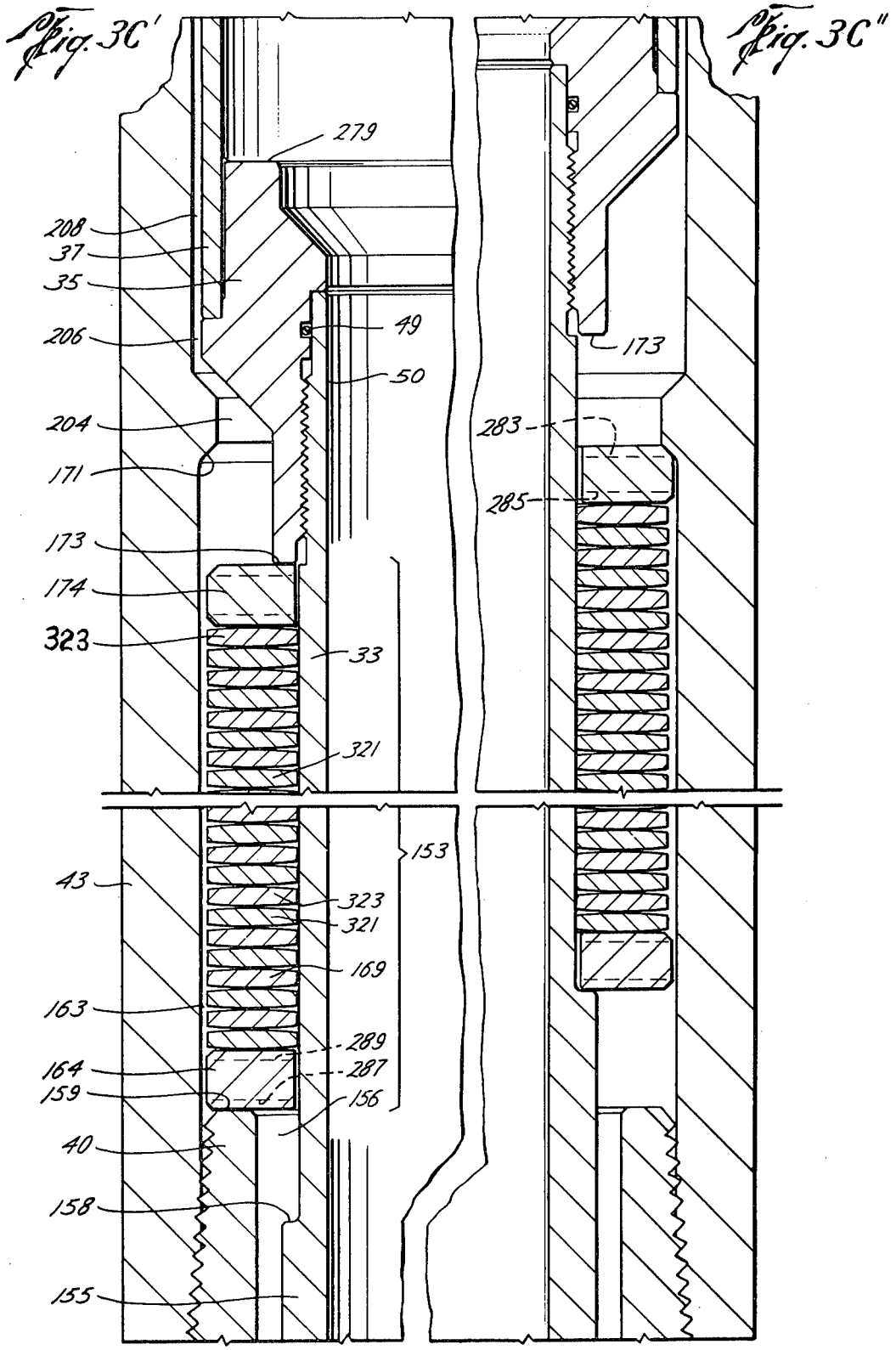
Figure 4A:
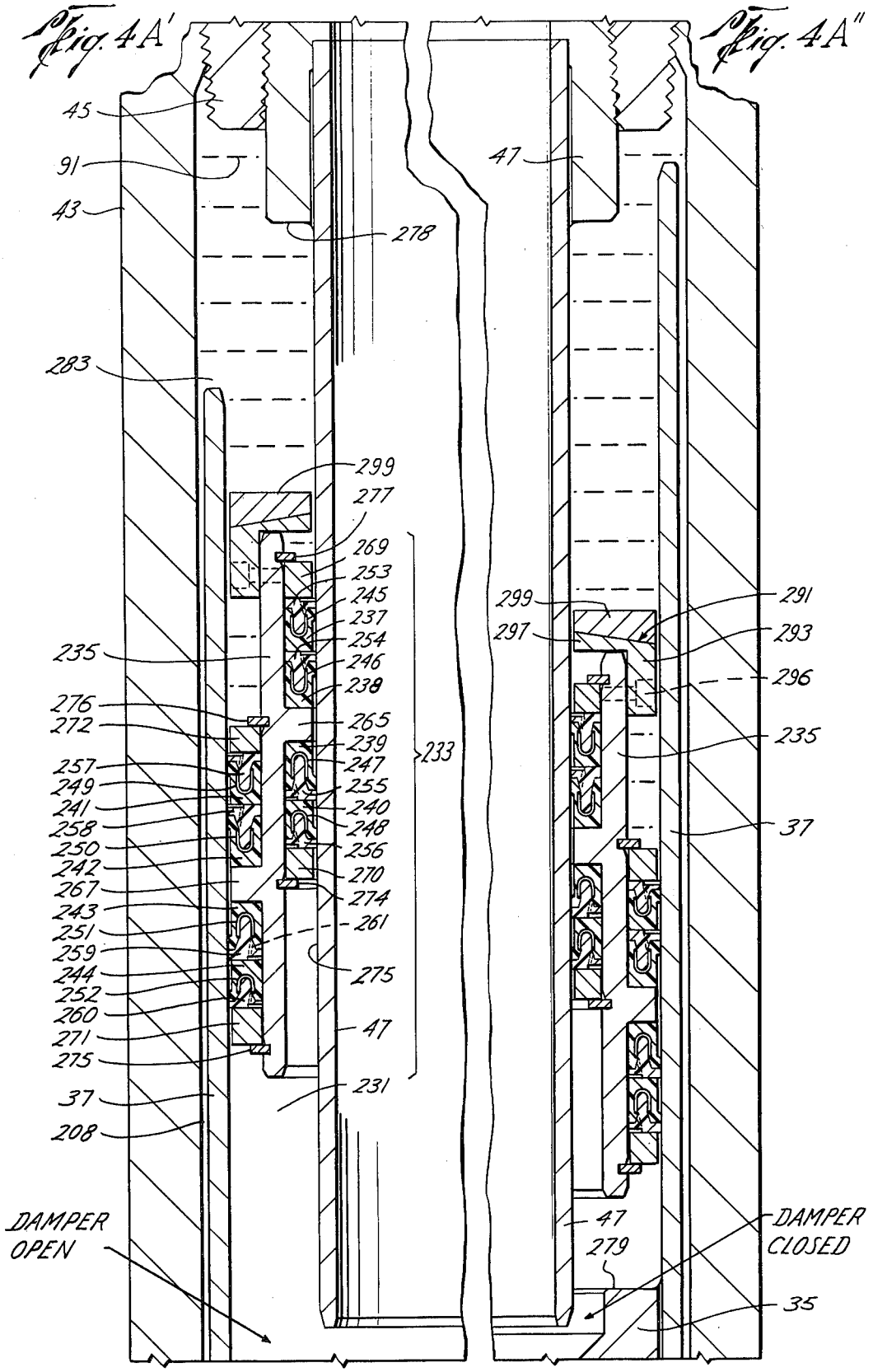
FIGS. 4A' and 4B', together hereinafter referred to as FIG. 4', are fragmentary sectional views, also to a larger scale than FIG. 1, showing the pressure volume compensating floating seal at the upper end of the damper being in the open or extended position.
Figure 4B:
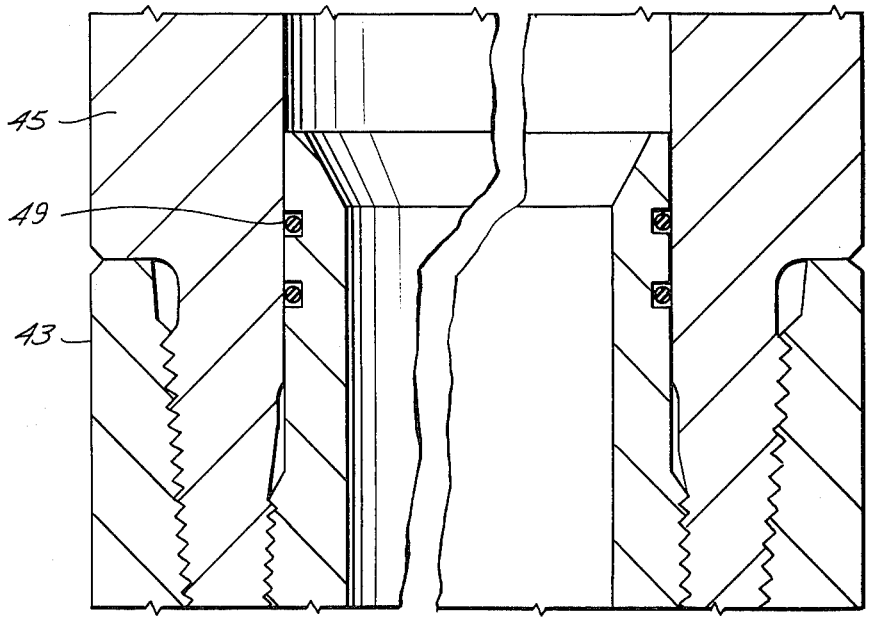
FIGS. 4' and 4" are drawn with a common center line for easy comparison and may be referred to together as FIG. 4.

Referring now in part to FIG. 3C′ and more particularly to FIG. 4, there is shown the upper part of the damper including mandrel portions 35 and 37 and barrel portions 43, 45, and 47. An annular volume 231 is formed between mandrel portion 37 and barrel portion 47. Due to the presence of cross over mandrel portion 35, mandrel portion 37 is of larger inner diameter than the outer diameter of the wash pipe formed by barrel portion 47; in other words, mandrel portion 37 is outside of barrel portion 47. Barrel portion 47 forms a part of and a continuation of the drilling fluid conduit means through the damper, which means, as previously mentioned, includes the passages 48, 50 through the interiors of tubular mandrel portions 31, 33.

Annular volume 231 between barrel portion 47 and mandrel portion 37 is closed by floating seal means 233 comprising tubular metal cartridge 235 carrying a plurality of sliding seal elements. Because barrel portion 37 is outside mandrel portion 47, an inversion of the usual barrel and mandrel relationship, any drilling fluid tending to flow through volume 231 must flow upwardly. Therefore detritus, sand and other particulates carried by the drilling fluid, when stopped by seal means 233, will fall down out of volume 231, away from seal means 233. For a discussion of downwardly facing seals, see applicant's French patent application Ser. No.

78/15034, filed 5-22-78, which presumably was published in print 18 months after the U.S. continuation date based on U.S. patent application Ser. No. 799,770 filed May 23, 1977.

Summarizing, there is no problem of drilling fluid particulates accumulating above the seal means at either the lower or upper end of the damper, since the spaces above these seal means are filled with lubricating oil and since at the lower faces of these seal means any drilling fluid particulates will fall out of the seal means due to the force of gravity.

Floating seal means 233 includes double lip, spring loaded seal rings 237–240 on the interior of cartridge 235 to seal between the cartridge and the outside of wash pipe barrel portion 47. Similar seal rings 241--244 seal between the outside of the cartridge and the interior of mandrel portion 37. Seal rings 237–244, similar to the seal rings in seal means 51 at the lower end of the damper, are provided with preload springs 245–252 to press their lips apart into sealing engagement with the cartridge and barrel and mandrel portions. Also, wedge rings 253–260 are provided to allow for stacking the seal rings in series, to ransmit forces from one seal ring to another, and to facilitate retention. The wedge rings are provided with weep holes, e.g. as shown at 261, for pressure balancing as in the case of the wedge rings forming parts of the sealing means at the lower end of the damper. The seal rings and wedge rings are retained on the cartridge against back up flanges 265, 267 by end rings 269–272 and snap rings 274–277, the latter being received in annular grooves in the ends of cartridge 235.

The whole seal means 233 is free to move as a unit axially up and down within volume 231, travel being limited by the upper end of the cartridge engaging annular shoulder 278 on washpipe barrel portion 47 and by the lower end of the cartridge engaging shoulder 279 on the upper end of mandrel portion 35. In normal operation the cartridge will never engage the stops. As long as the seal means is free to move, there is no pressure differential across it. It moves up or down so as always to be in contact with and supported by lubricating fluid 91 that fills the lubricant space between the barrel and mandrel in between pressure seal means 51 and floating seal means 233. Floating seal means 233 thus provides a pressure-volume compensator accomodating to changes in the volume of the lubricant space, allowing lubricating oil 91 to flow into the space 283 between washpipe barrel portion 47 and mandrel portion 37 when the lower part of the lubricant space between the barrel and mandrel reduces, and causing lubricating oil 91 to flow back into the space 283 when it enlarges, while keeping the lubricating oil separate from the drilling fluid at all times.

Lubricant Space

The space occupied by lubricating oil 91, extending from the lower part of the damper to the upper part thereof, may be traced from just above pressure seal means 51, past test probe electrode 93, between liner 121 and bearing surface 68, into space 281 between conical portions 123, 125, in between splines 131, 133, 135 and grooves 137, 139, 141, between flutes 147, through channels 282, 284 cut across the lower ends of nut 189 and tongue 209 (e.g. when the nut and tongue engage shoulder 175 as in FIG. 3A'), past the outer and inner peripheries of ring 183 (and its tongue 209) inside barrel portion 43 and outside mandrel portion 36, through spring pocket 162 inside and outside spring stack 167, between pressure ring 165 and shoulder 160 or 161 (one or the other is out of contact with the ring except in neutral position), or in neutral position through radial channels 286 (or 288) across the uppermost face of ring 165 as it happens to be assembled, through annular space 156 between barrel and mandrel, between pressure ring 164 and shoulders 159, 158 (one or the other is out of contact with the ring except in neutral position), or in neutral position through radial channels 287 (or 289) across the lowermost face of ring 164 as it happens to be assembled, through spring pocket 163 inside and outside spring stack 169, between ring 174 and shoulder 173 when out of contact or between ring 174 and shoulder 171 when out of contact (one or the other shoulder is out of contact except in the neutral position), or in neutral position through radial channels 283 (or 285) across the uppermost face of ring 174 as it happens to be assembled, through annular spaces 204, 206, 208, and into uppermost space 283.

Motion of Floating Seal

It is to be noted that when the damper is in use, the desired end result is zero axial motion of the barrel, which is connected to the upper part of the drill string, despite up and down motion of the mandrel, which is connected to the drill bit. As the mandrel moves up and down the volume of the space between the parts of the mandrel and barrel delimited by the lower seal means and the volume compensator changes and the compensator moves up and down to accomodate for the volume change. Large volume changes occur at space 281 between conical surfaces 123, 125 (FIG. 2) and at space 283 above the upper end of mandrel portion 37. Floating seal means 233 (FIG. 4) therefore moves up and down rapidly relative to both barrel portion 47 and mandrel portion 37 during operation of the damper. In the embodiment shown, the axial travel of the floating seal is about 3/5 of the axial travel of the mandrel relative to the barrel. For this reason the outer periphery of washpipe barrel portion 47 and the inner periphery of mandrel portion 37 are each provided with a hard metal coating, e.g. nickel plated, as shown at 275 and 276, such coating having a low friction coefficient and a smooth finish. Both wash pipe barrel portion 47 and mandrel portion 37 are readily replaceable should they become unservicable for any reason.

Although floating seal means 233 moves rapidly up and down to accomodate changes in volume of the space occupied by the lubricating oil, it may also move up and down more slowly in response to changes in the volume of the oil itself as temperature and pressure change.

Seal Position Indicator

Still referring to FIG. 4, on the upper end of cartridge 235 is disposed a cap 291 having a skirt 293. A plurality of screws 296 circumferentially spaced apart around the skirt extend through holes in the skirt into threaded holes in the cartridge. The upper end 297 of cap 291 has a conical top face pointing upwardly. Surmounting the cap is permanent magnet ring 299, which has a lower conical face correlative to the top face of cap 291, being suitably secured thereto, e.g. by epoxy cement or by sintering or soldering. Magnet ring 299 is magnetized radially, whereby its inner periphery is of one polarity and its outer periphery is of an opposite polarity. Cartridge 235 and wash pipe 47 are made of non-ferro-magnetic material, such as stainless steel. A magnetic probe, such as a steel building stud locator, lowered into wash pipe 47, will indicate the level of the magnet ring and hence of the floating seal. If the damper is fully contracted, as shown in FIG. 4A'', the floating seal should be near its lowermost normal position due to the lubricant flowing into the space 283 at its top side. If the damper is fully extended, as shown in FIG. 4A', the floating seal should be near its uppermost normal position, due to the lubricant flowing away from space 283 at its top side. If the damper is in its neutral position, the seal should be in a normal median position, as shown schematically in FIG. 1.

If the seals leak so that there is a loss of lubricant from the chamber, the floating seal will be near its uppermost position, or at least above its normal position. If the seals leak in a manner that intrusion of well bore fluid increases the fluid in the chamber, the floating seal will be at its lowermost position or at least below its normal position.

Of course in both conditions, insufficient and excess liquid in the chamber, the problem may not be with the seals but rather be one of initial insufficient or excessive filling of the chamber with lubricant. Whatever the problem is, it can be corrected.

Springs

Referring again to FIG. 1, and more particularly to FIG. 3, each of spring stacks 167, 169 comprises a plurality of Belleville spring washers 321 positioned with their cones pointing up, interleaved with a plurality of Belleville spring washers 323 disposed with their cones pointing down. This mode of stacking places the spring washers in series. The more spring washers in series, the greater the damper deflection for any given axial load. The use of two spring stacks in parallel reduces the stress in each Belleville spring washers for any given deflection of the damper. If required, additional stacks of spring washers beyond two stacks e.g. three, four or more stacks may be parallel to keep the stress in each Belleville spring washer below the elastic limit or below the endurance limit or any other desired limit.

It may be noted that merely making the spring washers thicker or stacking some of the Belleville spring washers in each unit in parallel, that is with their cones pointing in the same direction, though reducing some of the stresses in the spring washers, will not change the localized stresses over the areas of contact between adjacent oppositely pointed spring washers, which stress may be very high due to the nearly line contact between such spring washers and will not change the localized tensile stresses on the faces of the spring washers opposite to their areas of contact, and furthermore, in the case of springs paralleled within the stack, will cause sliding friction between the springs thus paralleled. Therefore paralleling several stacks may be necessary.

Due to manufacturing tolerances, the length of a spring stack of a preselected number of spring washers may not exactly fit the cavity between mandrel and barrel. In such case, as shown only in FIG. 1, one or more flat washers or shims 280, 282, 284 may be employed to achieve the desired fit. Alternatively, pressure rings 164, 165, 174, 183 (FIG. 3) of varying thickness may be employed.

Variable Moment Belleville Springs

Due to the small seal, FIG. 1 shows spring stacks 167, 169 to be composed of ordinary Belleville spring washers, i.e. with cross sections having straight sides. Although such springs may be employed while obtaining some of the advantages of the invention, and may even be constructed to provide a variable modulus as set forth, e.g. at pp. 155–157 of Mechanical Springs, by A. M. Wahl, Second Edition, published by McGraw Hill Book Company, 1963, it is preferred to use variable moment arm Belleville springs of the general type disclosed in the aforementioned Migny patent. Furthermore it is preferred to use a particular form of variable moment arm Belleville spring, herein termed a roller Belleville spring, in which there is pure rolling between adjacent washers as they are loaded and unloaded, as next described.

Roller Belleville Springs

Figure 7:
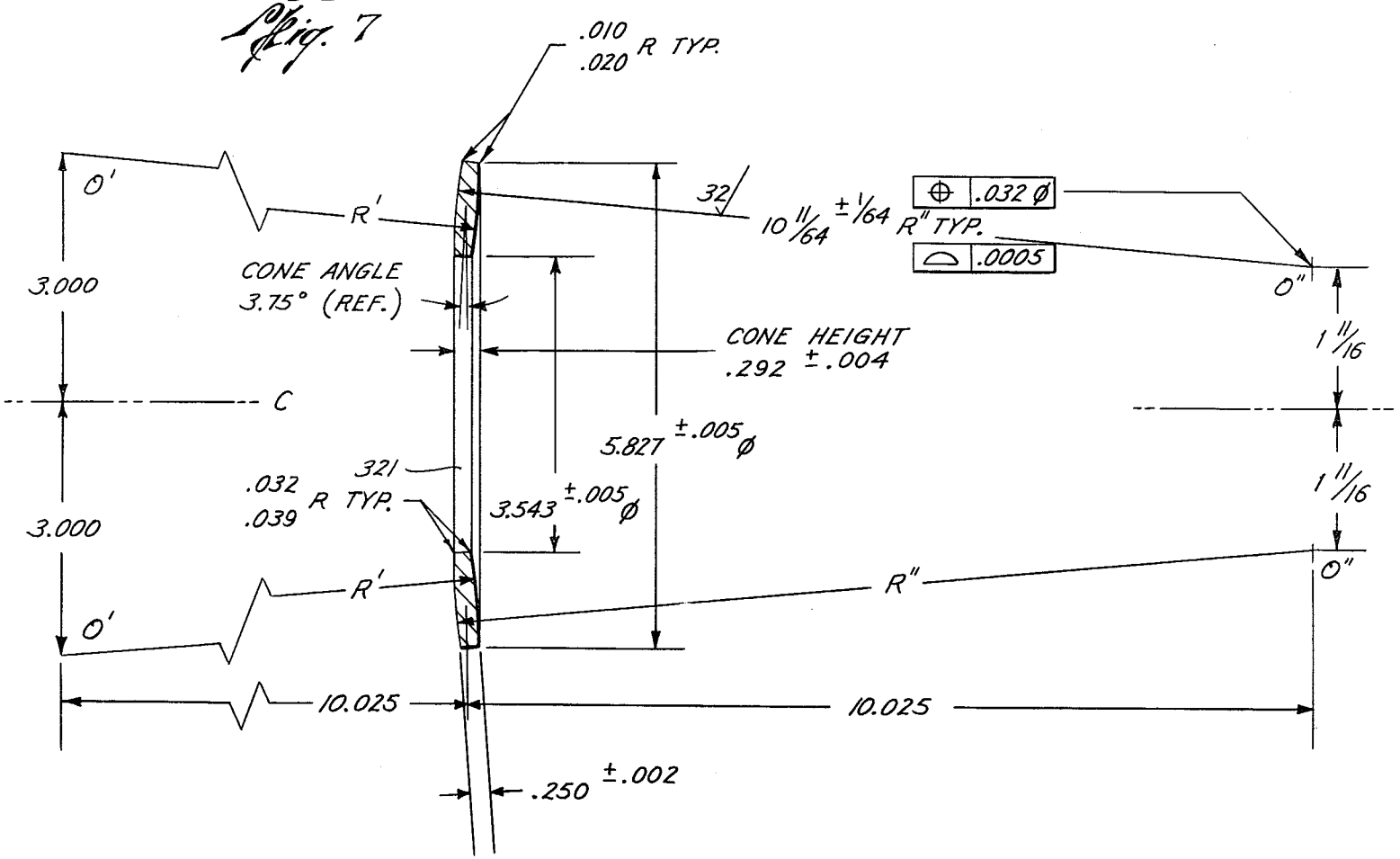
FIG. 7 is a sectional view of one of the roller Belleville spring elements.

The Belleville spring washers 321, 323 are identical, merely being positioned oppositely during assembly. Such a spring washers is shown to a larger and more precise scale in FIG. 7. As there shown, the radius $R'=R''$ of the outwardly and inwardly tilted faces of the spring washer is 10 11/64 inches. The outer diameter of the spring washer is typically 5.827 inches. The spring washer thickness is 0.250 inch and the cone angle is 3.75 degrees measured at the part of the spring washer midway between its inner and outer peripheries. It will be noted that the center O' of the radius R for the outwardly tilted face (the left hand side in FIG. 7) of the washer lies substantially on a line through the inner peripheral edge of such face parallel to the cone axis C of the washer. When the washer is stacked with others and assembled in the damper, the slight preload in the neutral position will cause the center of such radius R' to be exactly on said line.

Similarly it will be noted that the center O'' of radius R for the inwardly titled face (the right hand side of FIG. 7) of the washer lies substantially on a line through the outer peripheral edge of such face parallel to the cone axis of the washer. When the washer is stacked with others and assembled in the damper, the slight preload in the neutral position will cause the center of such radius R'' to be exactly on said line.

With O' and O'' so located for the neutral position of the damper, and $R^1$ being equal to $R_2$, the contacting areas of the washers of the inner and outer peripheries of the stack will, be tangent; when the damper is deflected the contacting areas of the washer move closer together and remain tangent, the washers rolling upon each other without sliding. It will be noted that when the contacting areas of the washer move together so as to be in vertical alignment, that is, so that they are equidistant from the axis of the washers, the moment arm becomes zero and the spring has gone solid. During the motion from unloaded condition to the solid condition, only the inner portions of the washer faces that are in contact nearest the washer axis are engaged and only the outer portions of the washer faces that are in contact farthest from the washer axis are engaged, such portions being the functional portions of the surfaces. The nonfunctioning portions of the washer surfaces never engage any other surface.

With the foregoing background, the conditions for pure rolling of the washer may be summarized as follows:

(1) The contacting areas of the faces of the washers are tangent, to avoid pivoting.

(2) The washers are identical, i.e. of like size, thickness, dish (cone angle), and facial curvature, so that they will have equal angles of deflection and the same position of their neutral axes, as required to avoid slippage.

(3) To avoid sliding, the curves of the functional portions of the two opposite faces of each washer should be the same, i.e. one curve would be the double reflection of the other about a medial cone and a cone perpendicular thereto (complementary therewith).

(4) The curves of the functional portions of the cross sections of the surfaces of the washers must be continuously convex, to avoid bridging.

For further discussion of this subject, see the aforementioned companion application of James B. Hebel.

Spring Clearance and Guidance

Figure 5:
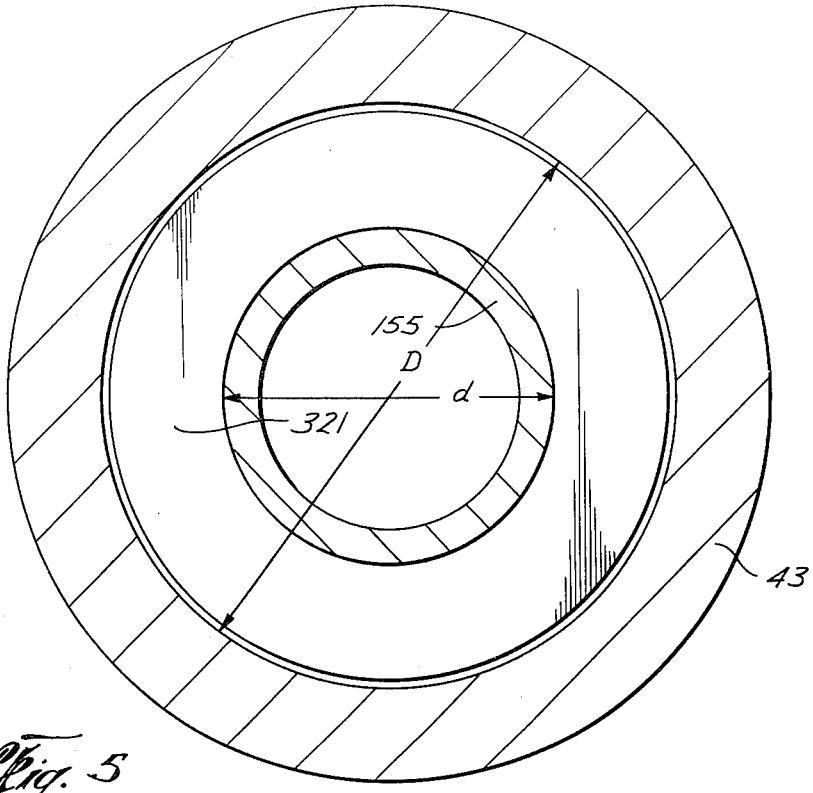
Figure 10:
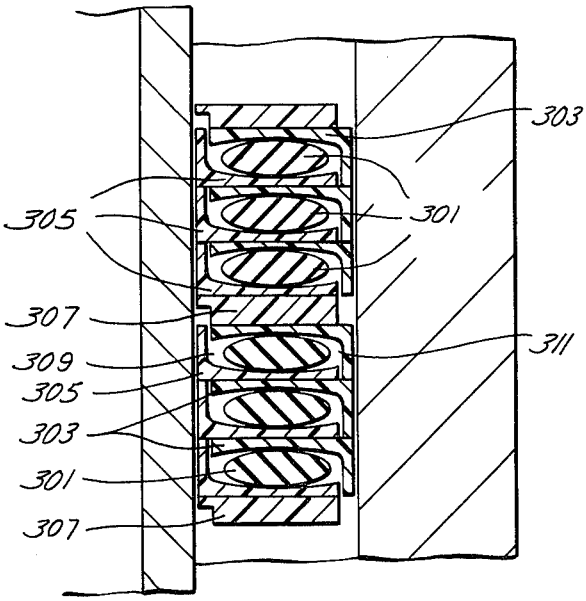
FIG. 10 is a fragmentary sectional view showing a modified form of resilient means.

Referring once more to FIG. 7 the minimum diameter of the inner periphery of the washer is 3.543+0.005 inches, which is enough larger than the diameter d of the outer periphery of mandrel 33 (FIG. 5) that the spring washers can freely move up and down axially relative to the mandrel even when the damper is extended or contracted causing the washers to be oompressed (flattened). If any part of the spring staok moves laterally, the mandrel will limit the movement, one or more of the spring washers making line contact with the side of the mandrel. The inner corners of the cross-section of the spring washer are more fully rounded to avoid cocking on the mandrel during assembly and to reduce stress concentration.

The outer periphery of the spring washers is considerably smaller than the inner diameter D (FIG. 5) of the barrel, so that the washers can expand circumferentially when they are compressed (flattened), as the damper extends or contracts, and still remain out of contact with the barrel. Also, there is left plenty of room for lubricating oil 91 to move past the washers.

If desired, the washers could more nearly make a close fit with the barrel and, at the same time, if so desired, less nearly make a close fit with the mandrel, relying on the barrel to limit lateral travel of the springs.

The minimum radial clearance between the inner and outer peripheries of the washers, and the adjacent outer periphery of the mandrel and inner periphery of the barrel required to accommodate for change in the spring washer diameters when flattened is only a few thousandths of an inch, which is less than that required by manufacturing tolerances.

Variable Spring Modulus

The spring stacks, when assembled in their respective pockets, are slightly compressed even when the damper is neither contracted nor extended, but only just enough to keep them from being loose in the pockets. In this condition, as shown in FIGS. 1 and 7A, the spring washers are in contact over circular areas near their inner and outer peripheries, each spring washer contacting either the inner or outer periphery of the spring washer above and the opposite (outer or inner) periphery of the spring washer below. This is the unloaded condition of the damper.

When the spring stacks are compressed, upon either contraction or extension of the damper, the circular areas of contact between the spring washers move away from the peripheries toward each other, i.e. towards the mid widths of the washers, as shown in FIG. 3. This results in a reduction of the leverage of the axial forces on the spring in their action to flatten the washers, causing the spring rate (force/deflection ratio) to increase. Roller Belleville springs thus have a pronounced variable spring modulus.

Figure 8:
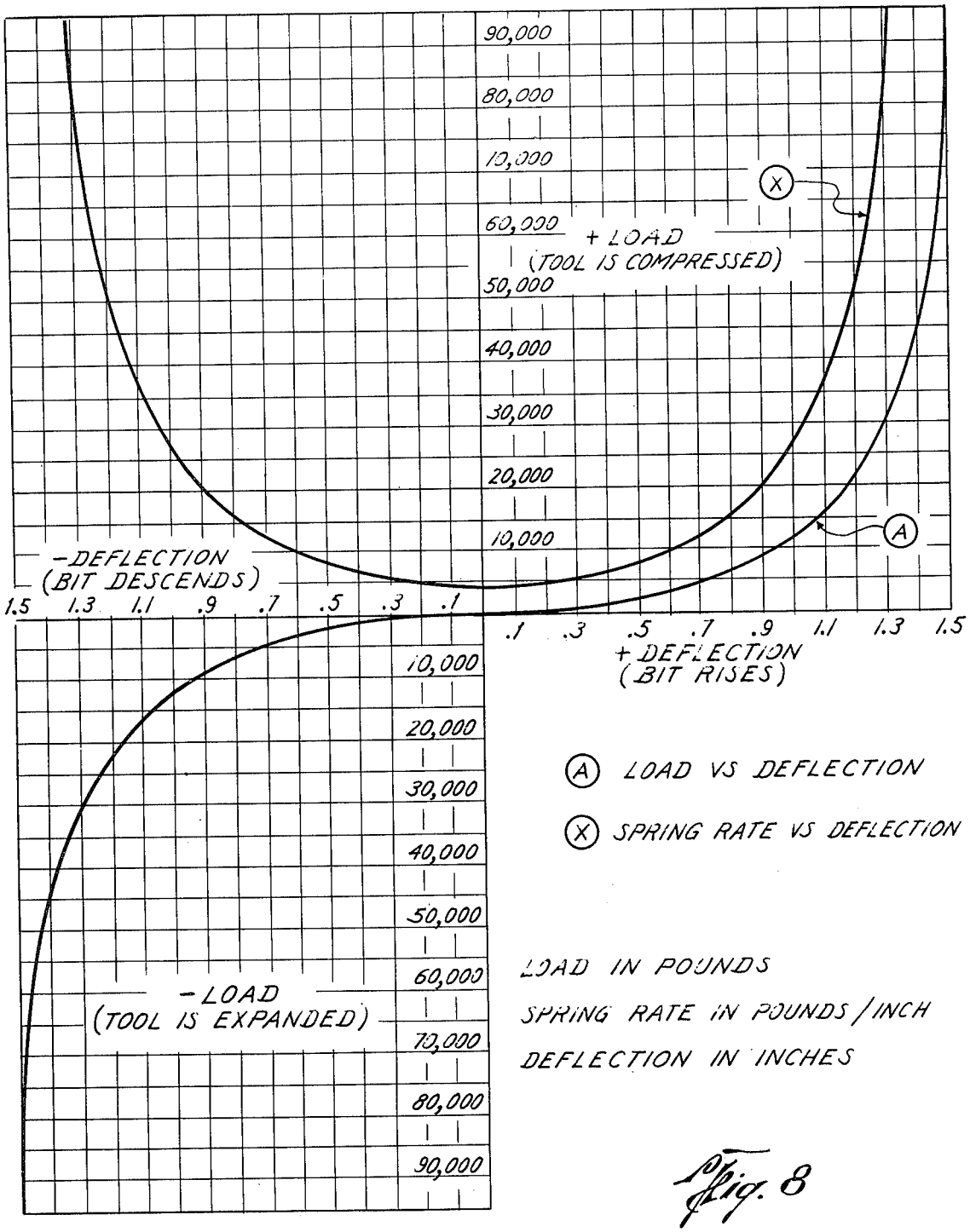

Referring now to FIG. 8, there are shown a curve A plotting spring force versus deflection, and also a curve X plotting spring rate versus deflection. Curve X shows a very low spring rate of the order of 4,000 to 10,000 lb./in. at moderate values of spring deflection, reflecting the low slope of the nearly straight line portion of the spring force deflection curve A below 10,000 lb. At a deflection of 1.0 inch, corresponding to a spring force of 12,500 lb., the spring rate is still less than 30,000 lb./in. Even at a deflection of 1.3 inches, corresponding to a spring force of 30,000 lb., the spring rate is but 85,000 lb./in. Only as the deflection approaches the travel limit of 1.5 inches does the spring rate exceed 100,000 lb./in. to bring the damper travel to a cushioned stop.

Double Action

FIG. 8, curve A, also shows that for negative loads, i.e. loads tending to extend the damper, the load deflection curve is reflected about the ordinate. In other words, the same load deflection curve, except with negative deflections, applies. That is because the resilient means is being stressed regardless of whether the damper is being contracted or extended. In fact, in the preferred embodiment the same spring means is strained in the same way (flattened) regardless of whether the damper is contracted or extended.

Balanced Load Drilling

Referring now to FIG. 9, there is shown curve A, which is the same as curve A of FIG. 8, plotting spring force as a function of spring deflection. FIG. 9 also shows a curve B plotting spring force as a function of decreasing spring flexibility, that is, the abscissae scale of curve B has its origin at a flexibility of 25 inches per 100,000 pounds, with decreasing flexibility proceeding away from the origin. Also, flexibility is plotted as positive both to the left and to the right of the origin; this accounts for the fact that the flexibility curve includes a portion in the lower left hand quadrant rather than in the upper left hand quadrant. Flexibility is the reciprocal of spring rate; therefore curve B is closely related to curve X of FIG. 8. However spring rate curve X is plotted against deflection whereas curve B plots spring force against flexibility. Note further that in curve X, spring rate is plotted as ordinates, whereas in curve B flexibility is plotted as abscissae. In fact in Figure 8, one should consider the abscissae, the deflection, as the independent variable, reflecting the fact that the bit moves up and down as the contour of the bottom changes, to some extent regardless of what force is imposed on the bit, whereas FIG. 9 is best appreciated viewing the ordinates, the spring force, as the independent variable, reflecting the information known to the driller, i.e. the static load on the damper.

It may be noted here that although the static load on the damper is the difference between the drilling weight and the pump apart force, the load on the bit is the drilling weight, unaffected by the pump apart force. Although the pump apart force acts down on the bit, it also acts upwardly on the swivel to relieve the draw-works of some of the drill string weight. Since drilling weight is calculated on the basis of weight of drill string less line tension, the upward pump apart force, which actually further reduces the unsuspended weight of the drill string, equals the downward pump apart force acting to increase the force on the bit over that which is due to the unsuspended weight of the drill string. In other words, the pump apart force is neglected twice with opposite effect.

FIG. 9, in the upper left hand quadrant, includes a table showing typical drilling conditions. The items in the table, and elsewhere in FIG. 9, that are marked with a check mark, correspond to a near balanced load condition, CONDITION I, including an average drilling weight of 45,000 pounds and an average pump pressure of 1,500 psi corresponding to a pump apart force of 44,000 pounds. The items marked with an asterisk correspond to an extreme condition, CONDITION II, wherein the pump apart force dominates, the pump pressure of 2,000 psi producing a pump apart force of 59,000 pounds compared to a drilling weight of only 30,000 pounds, a difference of 29,000 pounds acting to expand or extend the damper. The items marked with a double dagger correspond to an extreme condition, CONDITION III, wherein the drilling weight dominates, the pump pressure of only 1,000 psi producing a pump apart force of only 29,000 pounds compared to a drilling weight of 60,000 pounds, a difference of 31,000 pounds acting to compress or contract the damper.

Having noted the parameters in the upper left hand quadrant of FIG. 9, one may refer to the scale of pump pressures at the lower left hand side of FIG. 9. There, selecting a pump pressure of 1,500 psi, marked with a check mark, and following the heavy line in the direction of the arrows, one finds that this pressure corresponds to 44,000 pounds of pump apart force, a negative force, i.e. one expanding the damper, to which one adds a positive force of 45,000 pounds of drilling weight to provide a net force of 1,000 pounds contracting the damper, at which load the flexibility of the damper is a maximum, i.e. 25 inches per 100,000 pounds. This is CONDITION I.

Further exploring FIG. 9, one may start at the lower left at a pump pressure of 2,000 pounds marked with an asterisk, and following the dotted line one first notes that this pump pressure produces a pump apart force of minus 59,000 pounds. To this is then added a drilling weight of 30,000 pounds leaving a net negative force of 29,000 pounds expanding the damper, at which point the flexibility of the damper is 0.85 inch per 100,000 pounds. This is CONDITION II.

Condition III may also be traced on FIG. 9, starting at the lower left with a pump pressure of 1,000 psi, marked with double dagger. Following the broken line one finds that 1,000 psi pressure corresponds to a pump apart force of minus 29,000 pounds. Adding a drilling weight of 60,000 pounds creates a net contractive force on the damper of 31,000 pounds, which corresponds to a flexibility of 0.80 inch per 100,000 pounds, substantially the same as for CONDITION II.

Assuming a case wherein the pump apart effect balances the unsuspended weight of the drill string (drilling weight), identified as CONDITION I in FIG. 9, there is no static load on the damper spring and the damper will operate about the zero load, zero deflection point, the origin of the FIG. 9 load-deflection curve, which is the neutral position as previously defined. The damper will then be very soft and very little motion will be transferred to the drill string. This is in contrast with single acting variable modulus dampers in which under balanced load condition alternate half cycles of vibration would cause engagement of the travel stops, thereby losing the benefit of the low spring rate on alternate half cycles of damper vibration.

Consider next the case of drilling with unbalanced load. As the unbalance increases, the flexibility at the static deflection point decreases. However, at a load unbalance of plus or minus 10,000 lb., the flexibility is still over 4 inches per 100,000 lb., which is very high, and the deflection is about 0.95 in. which leaves 0.55 inch of travel to the nearest travel stop.

It may be noted here that the drop in flexibility from 25 inches per 100,000 pounds under balanced load conditions to 4 in./100,000 lb. at 10,000 pounds unbalance appears to be major. However the amplitude of transmitted vibration to impressed vibration is actually more nearly a function of the reciprocal of flexibility, i.e. of spring rate, and as appears from FIG. 8, at a deflection of 0.95 in. the spring rate is only about 23,000 pound/in., which is still quite low.

If the drilling weight exceeds the pump apart effect, or vice versa, by thirty thousand pounds, the conditions are those identified on FIG. 9 as CONDITION II and CONDITION III. Conditions II and III represent extreme conditions of load unbalance which are met in practice perhaps only about 5 percent of the time. However even under these conditions although the action of the damper is not as good as under balanced load, the damper, having a flexibility of 0.8 or more and a travel of 0.2 into the nearest stop, is still soft enough to dampen substantially transmission of vibration to the drill string. The damper therefore may be used with varying degrees of effectiveness over a typical range of drilling weights in the range from 30,000 pounds to 60,000 pounds and pump apart forces in the range from 30,000 pounds to 60,000 pounds corresponding to a $6\frac{1}{8}$ inch diameter seal area (e.g. 8 inch diameter damper) with pump pressure in the range of 1,000 psi to 2,000 psi.

Stroke

Assuming the drill string above the damper to be at rest vertically, the damper needs to have sufficient contractive and extensive stroke to allow for the maximum anticipated rise and fall of the drill bit without having the damper become inoperative by the travel limit stops becoming engaged or the springs reaching their limit of deformation (going solid i.e. flat in the case of Belleville springs). It will be seen from FIG. 8 that the damper has a working range of plus or minus one inch deflection with a very low spring rate when the pump apart effect balances the drilling weight. Even at the extreme condition of a thirty thousand pound difference (plus or minus) between drilling weight and pump apart effect, there is still available a travel of about 0.2 inch in the direction toward the nearest travel limit stop before the spring rate of the spring stacks becomes exceedingly high.

Figure 9A:
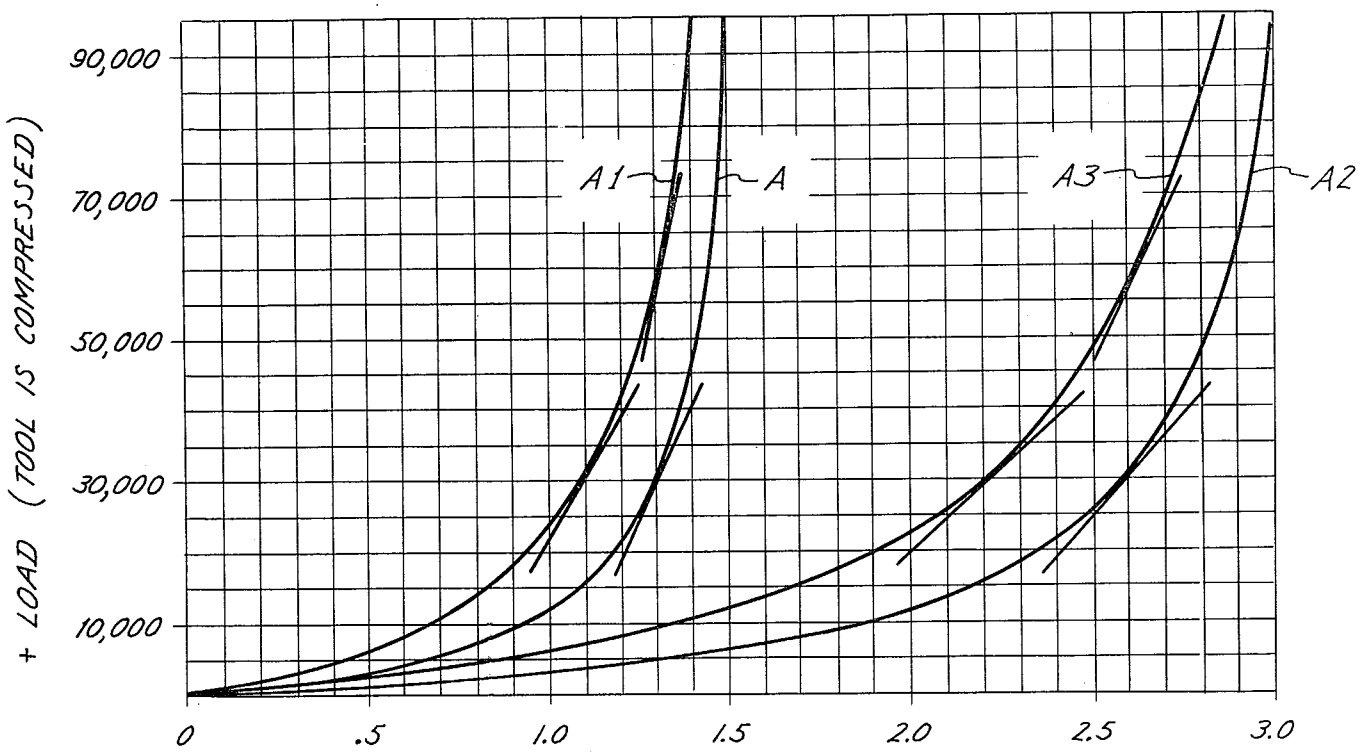

If one is willing to accept a higher spring rate at balanced load, the available travel to the nearest stop for any given unbalanced load and the spring rate at that load can both be enhanced by employing additional stacks of springs in parallel. Referring to FIG. 9A, curve A shows the load deflection curve for the previously described apparatus. Curve A1 shows the result of employing four stacks of springs in parallel (twice as many as for Curve A). It is seen that although the spring rate for balanced load is doubled (twice the slope), it is still very low, and at 30,000 lb. static load the deflection is only 1.1 inch, leaving 0.4 inch travel to the nearest stop (compared with 0.2 in. for curve A) and the spring rate is lower (lower slope) than for curve A.

Curve A1 also shows that at 60,000 lb. static load (twice the limit of the working range for the damper of Curve A) the deflection is only 1.3 inches, the same as for a 30,000 lb. load in the case of the curve A damper (although the spring rate is greater for curve A1 at 60,000 lb. than for curve A at 30,000 lb.

Summarizing, by putting more variable modulus springs in parallel, one can not only reduce the deflection, but also reduce the spring rate at the same 30,000 lb. static load, or increase the static load for the same 1.3 inch deflection.

If an overall longer stroke is required, the lengths of the spring stacks can be increased. For example, referring now to curve A2 of FIG. 9, by doubling the length of the spring stacks, the low spring rate working range would become plus or minus two inches, and there would be a travel of about 0.4 inch to the nearest travel stop when static load is unbalanced by 30,000 pounds.

Lengthening the spring will also lower the spring rate in the middle of the range, e.g. at the neutral position. Therefore if it is desired to increase the working range of unbalanced load as well as increase the stroke, without sacrificing flexibility at any load, additional stacks of springs in parallel may be employed. For example, by both doubling the lengths of the springs and employing twice as many in parallel as shown in curve A3, the same low spring rate at midrange as for curve A will be achieved, and the unbalanced load working range for the same maximum spring rate within the range will be increased to plus or minus 60,000 lb. with a travel limit of 0.4 inches to the nearest stop.

It is to be particularly noted from curve A2 that by doubling the spring length and the number of stacks in parallel, the travel to the nearest stop at plus or minus 30,000 pounds would be increased to 1.08 inches and the spring rate would be only about 25,000 lb/in. This improved effect achieved with the seriating and paralleling of variable modulus springs is in contrast with that achieved with constant modulus springs where only the travel to nearest stop would be increased without any change in spring modulus.

COMPARISON

The subject construction with a stroke of plus or minus 1.5 inches and a spring rate of 30,000 lb./in. or less over a range of plus or minus one inch when operating under balanced load conditions, is to be compared with the result that would be obtained with a constant spring rate and with single acting spring means.

First of all consider the situation with a constant spring rate single acting spring means having a spring rate of 4,000 lb. per inch, corresponding to the spring rate of the present construction at zero deflection. Upon imposition of a static load of thirty thousand pounds, the deflection would be 7.5 inches, which is way beyond the range of travel of the assumed situation. To accomodate such a stroke, the seals, spline, and guide bearings would all have to be lengthened, as well as providing a spring of such a stroke. The question arises if this problem could be overcome merely by changing the position of the travel limit stops. The answer is simply, no. If the stops were set to limit deflection to plus or minus 1.5 inch, upon imposition of an unbalanced static load of only 6,000 pounds the damper would be in engagement with one stop and therefore inoperative on alternate half cycles.

At this point one may introduce the concept of the load carrying capability of a spring. This is the maximum load which a spring can carry without going solid, or otherwise expressed, the maximum load which a spring can carry and still function as a spring, i.e. as a device in which the ratio of load to deflection per unit length of spring is less than the modulus of elasticity of the material of which the spring is made. In the instant case, unless the spring of the spring means has a load carrying capacity of thirty thousand pounds, it will not be effective as a spring upon imposition of a 30,000 pound load, no matter where the travel limit stops are placed. If a spring is soft, it likely will have a low load carrying capacity.

Consider next a damper with a constant spring rate of 30,000 lb./in., near the maximum rate for the damper of the present invention, when operating under balanced load conditions. Under a static load of 30,000 lb., the spring deflection would be one inch, leaving only a half inch of travel to reach the nearest travel limit stop. Since a one inch deflection is to be expected according to the original assumptions, such a damper would strike its travel limit stop once during each cycle of vibration, there being no increasing modulus as the stop is approached to cushion the end of the travel.

To provide a one inch travel to the nearest stop when operating with a 30,000 lb. static load, the spring rate would have to be such that the static deflection would be only one-half inch ($1.5-1.0=0.5$). In other words, a constant spring rate of $30{,}000/0.5=60{,}000$ lb./in. would be required. This is fifteen times as stiff as the zero deflection spring rate of the previously described construction embodying the invention. In addition, should there be any abnormal deflection of a damper with the assumed 60,000 lb./in. constant spring rate, the damper would strike its travel limit stop. In contrast, the spring means of the present construction, being of increasing spring rate as the deflection approaches the limits, will still effect a cushioned stop upon abnormal deflection, even though the cushioning will be less than under normal conditions.

Consider next the case of a known damper employing a variable modulus spring but with single action. Such a damper operating under balanced load would strike its travel limit stop once during each vibration.

CONSTANT BIT LOAD DRILLING

The type of drilling contemplated by the present invention may be further understood by referring once more to FIG. 8. It will be seen from curve X that for deflections between plus and minus 0.5 inches the spring rate is nearly constant and quite low. Therefore, if drilling is conducted in such a manner that the pump force balances the drilling weight so that the static deflection of the damper is zero, the damper will allow the drill bit to move up and down following the contour of the bottom of the hole under the constant downward force of the pump apart force with very little force variation transmitted to the drill string through the damper. Since the bit will remain in contact with the bottom of the hole with the desired force on bottom, drilling should proceed in a most efficient manner and at the same time there will be minimum wear and tear on the drill string.

MODIFICATION

Although according to the preferred embodiment of the invention roller Belleville springs are employed, variable modulus spring means other than roller Belleville springs may also be used.

As an example of the latter construction, FIG. 9 illustrates a form of spring stack to be disposed in a damper pocket, similar to the pockets 162, 163 in the previously described embodiment. The stack comprises ovoid cross-section elastomer quoits 401 each sandwiched between pairs of L-shaped cross-section steel washers 403, 405 which slide freely in the pockets between mandrel and barrel. The washers are in peripheral engagement, placing the quoits in parallel. Groups of paralleled quoits, e.g. group of three quoits, are separated by steel spacers 407 placing the groups in series. With this arrangement, by selecting the number of quoits in a group, the total number of groups, and the cross-sectional shape of the quoits, most any stress limit on the quoits and travel range for the damper can be obtained. As compared with roller Belleville springs, a softer, no load spring rate will be typical, with a sharply increasing rate as the elastomer quoits deform and the metal washers come closer together and the elastomer fills the voids 409, 411 present at the inner and outer peripheries of the quoits when unloaded.

Though the rubber quoit sandwich construction has the advantages of greater softness, a disadvantage is the fact that rubber cannot be used in high temperature wells. Also, rubber has considerable hysteresis or internal friction which may reduce the life of the spring means.

While a preferred embodiment of the invention and a modification thereof have been shown and described, many further modifications can be made by one skilled in the art without departing from the spirit of the invention.

Figure 18:
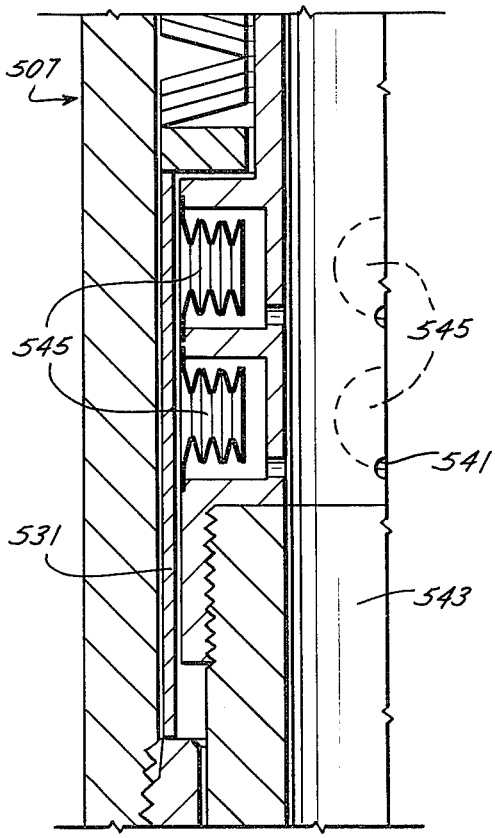
FIG. 18 is a view similar to FIG. 15 showing a modification of a part of the tool of FIG. 11.

For a description of the prototype modification of the invention referred to previously in the description of the Evolution of the Invention under the heading Belleville Springs, and in the Summary of the Invention as the sealed seal contruction, reference will now be made to FIGS. 11–22. FIGS. 11–17 show a sealed seal vibration damper, FIG. 18 shows a modification thereof relating to the volume compensator, FIGS. 19–22 show a hydraulic jar incorporating the sealed seal construction, and FIG. 23 shows a modification of the latter relating to the spline. All parts are drawn to scale in FIGS. 11–22 and the conventions of the U.S. Patent and Trademark Office for identification of materials are employed, from which it will be seen that the tools are made entirely of metal, e.g. steel, except for the seals, which can also be made of metal, except preferably the high pressure seal, which is made of suitable packing material resistant to high temperature and pressure, e.g. polytetrafluorethylene.

SEALED SEAL DAMPER

Referring first to FIG. 11, there is shown a vibration damper 401 connected in a drill string between a three cone drill bit 403 and a drill collar 405. Damper 401 includes an inner tube or mandrel 407 telescopically disposed within an outer tube or barrel 408.

Inner tube 407 comprises a main tube 409, a tubular extension 411 screwed to the main tube at 413, and a ring 415 screwed to the extension at 417. Main tube 407 has a threaded pin 419 at its lower end to which threaded box 421 of the bit is connected.

Outer tube 408 includes an outer tube or barrel 408 comprising a skirt 425, a lower tube 427, an upper tube 429, and a top tube 431. The skirt and lower tube are threadedly connected together at 433. Threaded boxes 435, 437 on the adjacent ends of the lower and upper tubes are connected by buried split threaded double pin 429, similar to the construction shown in U.S. Pat. No. 3,581,834 to Kellner, et al. A threaded box 441 at the upper end of the outer tube is connected to a threaded pin 443 at the lower end of the top tube. The upper end of the top tube is provided with a threaded box 445 which is threadedly connected to threaded pin 447 at the lower end of drill collar 405.

Figure 16:
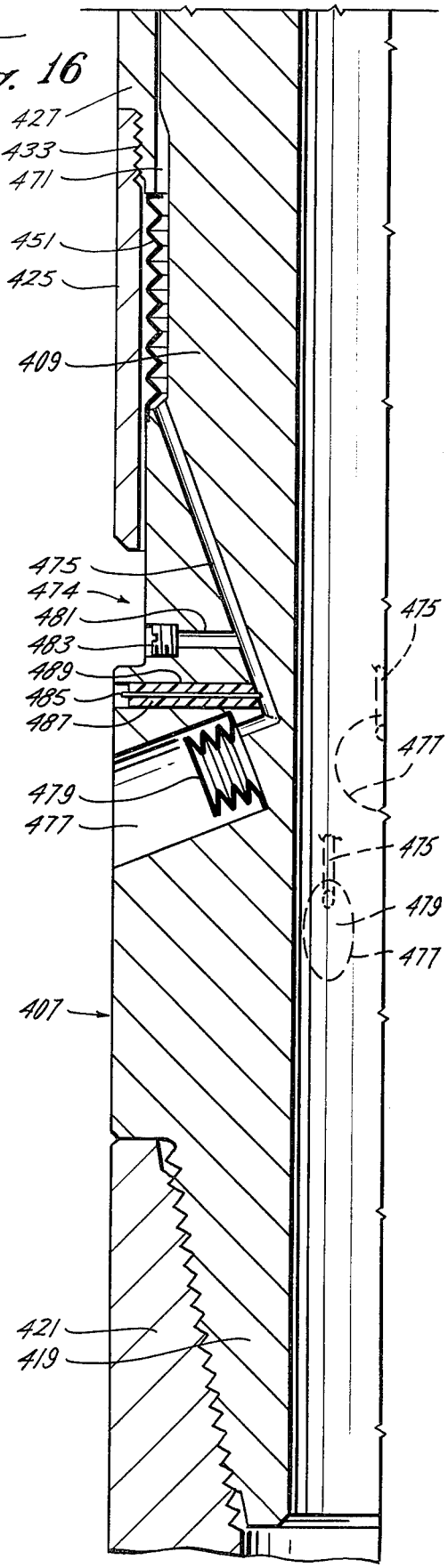
Figure 17:
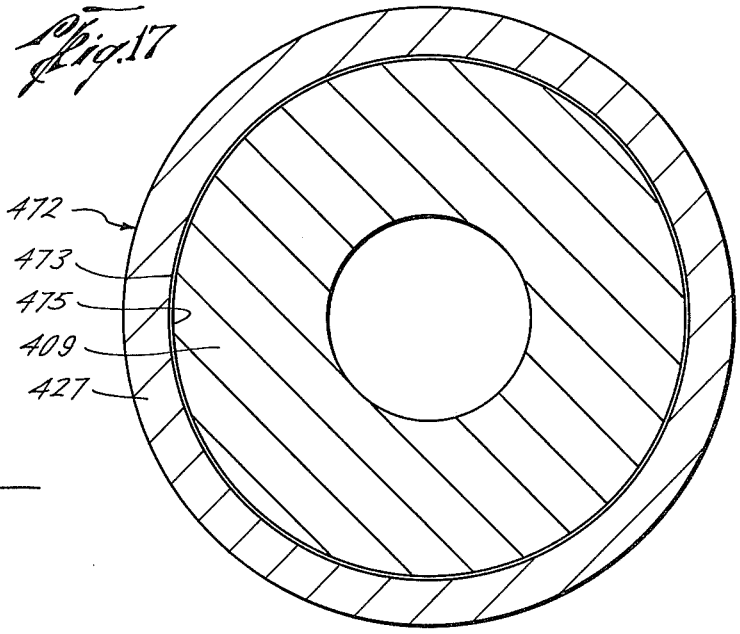
FIG. 17 is a section at plane 17—17 of FIG. 13.

Referring now to FIG. 16, inside of and protected by skirt 425 is a bellows 451 made of metal such as brass or stainless steel or plastics material such as Teflon or other suitable high temperature resistant material. Bellows 451 is secured at its ends in fluid tight relationship to lower outer member 427 and main inner member 409 respectively.

Figure 15:
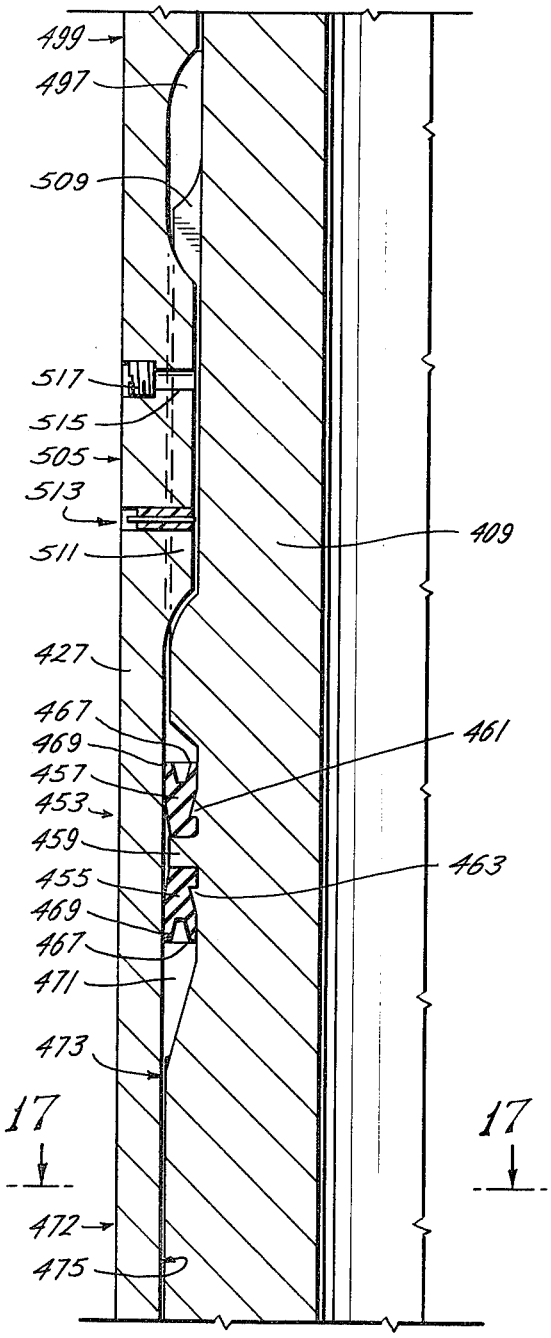

Referring now to FIG. 15 above the lower flexible seal means provided by bellows 451 is sliding pressure seal means 453 provided by two oppositely directed, double lip, seal rings 455, 457, the upper ring having its lips facing upwardly and the lower ring having its lips facing downwardly. The rings abut against flange 459 on the outer periphery of main tube 409 of the inner tube and are locked against axial displacement by annular barbs 461, 463 engaging correlative annular grooves in the seal rings. As best shown in FIGS. 13A, 13B, after the seal rings have been installed on the inner tube, a plurality of circumferentially spaced leaf springs 465 are placed between the inner and outer lips 467 and 469 to spread them apart. This is desirable to insure initial sealing at low pressure since the seal rings are preferably made of low gas absorptivity, high temperature resistant material such as polytetraflourethylene (Teflon) which is less resilient than the usual elastomeric seal material such as rubber.

In the lower chamber 471 formed between lower flexible seal 451 and sliding pressure seal 453 is disposed lower bearing means 472 comprising close fitting smooth inner and outer peripheral surfaces 473, 475 on the outer and inner tubes, respectively. Their surfaces are adapted to slide axially relating to each other and to transfer between the inner and outer tubes radial forces created by bending moment or side thrust applied to the damper.

To protect lower flexible seal 451 against rupture there is provided lower pressure equalization and volume compensating means 474 as follows: The pressure inside space 471 is balanced with that outside the damper by connecting the space with one or more passages 475 and ports 477 in the outer periphery of the main tube 409. To keep the well fluid outside the damper from entering the chamber and contacting the lower bearing means and pressure seal 453, a flexible bellows 479 closes the juncture of passage 475 and port 477 while allowing pressure transfer therebetween. To keep bellows 479 at a reasonable size space 471 is filled with a liquid rather than a gas which would have to compress a great deal to effect the desired pressure equalization as the damper is lowered into a well. Preferably the liquid is a light lubricating oil, thereby lubricating both bearing surfaces 473, 475 and pressure seal 453.

Typically bellows 479 is made of non-corrosive high temperature resistant material such as a suitable metal, e.g. stainless steel or brass. However, a plastics material bellows could be employed, as could other flexible material resistant to high temperature and corrosion by well fluid.

Bellows 479 serves not only as a pressure equalizer and fluid separator but also as a volume compensator, for as the damper contracts and extends, the volume between pressure seal 453 and lower flexible seal 451 decreases and increases. If more volume compensation is needed than that provided by one bellows 479, additional bellows 479 may be employed, separating additional ports 477 from additional passages 475. Such additional ports, passages, and bellows may be distributed circumferentially about the inner tube as shown in dotted lines in FIG. 12, and/or they may be distributed axially along the length of the inner tube, also as shown in dotted lines in FIG. 12. The lower bellows could be staggered or aligned with those above.

Means to fill lower lubricant chamber 471 comprises passage 481 communicating at its inner end with passage 475, the outer end of passage 481 being closed by removable screw plug 483 screwed into a threaded counterbore at the outer end of passage 481.

To test the electric conductivity of the oil in lower chamber 471, a brass or other conducting metal electrode 485 is molded concentrically in a ceramic tube 487 which is cemented within a radial passage 489 in the inner tube communicating with passage 475 near the lower end thereof. The inner end of the electrode extends beyond the ceramic tube into passage 475 and the outer end of the electrode extends beyond the outer end of the ceramic tube close to the outer periphery of main inner tube 409. As shown in FIG. 11, an ohmmeter 491 can be employed to measure the resistance between the outer end of the electrode and the main tube, which resistance is primarily that of the lubricating oil, the oil in chamber 471, being a good insulator when uncontaminated. If there is any leakage of well fluid into chamber 471, the oil will become more conductive and such condition can easily be determined by means of the ohmmeter.

Referring now to FIGS. 11 and 12, near the upper end of the damper a bellows 493 made of material like that of lower flexible seal bellows 451 is secured at its ends in fluid tight relationship to ring 415 of the inner tube and protecting skirt 495 welded to top tube 431 of the outer tube. Between upper flexible seal 493 and pressure seal 453 is formed an upper chamber 497 which is filled with lubricant the same as lower chamber 471.

Since upper and lower flexible seals (bellows) 451 and 493 are secured to both the inner and outer tubes, they may be referred to as double anchored seal means, as distinguished from sliding pressure seal means 453.

Referring now also to FIG. 14, within the chamber is upper bearing means 499 comprising close fitting smooth inner and outer peripheral surfaces 501, 503 on the outer and inner tubes, respectively. Like surfaces 473, 475 of the lower bearing means, surfaces 501, 503 are adapted to slide axially relative to each other and to transfer between the inner and outer tubes radial forces created by bending moment or side thrust applied to the damper.

SPLINE AND SPRING

Also disposed in upper chamber 497 are spline means 505 (FIGS. 1 and 15), which is below upper bearing means 427, and resilient means 507 (FIGS. 1 and 13) which is above the upper bearing means. The spline means is similar to that described in connection with FIGS. 2B′, 2B″ and 6. Specifically, spline means 507 includes external splines 509 on the outer periphery of the inner tube sliding axially between and rotationally interlocked with internal splines 511 on the inner periphery of the outer tubes. Since the spline means is near the lower end of the upper chamber, electrode means 513 similar to electrode means 485, 487, 489 is provided in the outer tube at this end, whereby the electrical conductivity of the oil in chamber 497 can be tested with ohmmeter 491 whenever desired. To fill and drain chamber 497 there is provided a port 515 in the outer tube, the port being closed by removable screw plug 517.

Referring now to FIG. 13, resilient means 507 is similar to resilient double acting spring means 151 (160, 161, 165, 167, 176, 177, 289, etc.) of FIGS. 1, 3A′, 3A″, 3B′, & 3B″. Resilient means 507 includes a column 521 of Belleville spring frusto-conical washers comprising series stacked groups of washers with three parallel stacked washers 523 in each group. Compression rings 525, 527 are disposed at the ends of the column. Upon extension of the damper, the compression rings will be pushed together between inner tube downwardly facing shoulder 529 and spacer sleeve 531 which bears against outer tube upwardly facing shoulder 533, thereby compressing the spring column. Upon contraction of the damper, the compression rings will be pushed together between outer tube downwardly facing shoulder 535 and inner tube upwardly facing shoulder 537.

Spring means 507 differs from the previously described spring means 151, etc. in that the Belleville washers are of constant moment arm and are stacked in parallel within the groups resulting in a nearly constant modulus with considerable frictional damping and an initially higher modulus. Spring column 521 may be viewed as merely nominal or exemplary of spring means generally; to obtain the desired results of the dampers previously described in connection with FIGS. 1–10, one of the variable modulus spring means of FIGS. 1–10 will be substituted for spring column 521.

Upper chamber 497 is provided with pressure equalizing and volume compensating means 540 provided by a plurality of ports 541 communicating the interior flow passage 543 through the inner tube with a plurality of recesses 543 in the inner tube opening to the outer periphery of the inner tube. Bellows 545, similar to bellows 479, disposed in recesses 543, are connected in fluid tight relationship to the mouth of recesses 543, thereby separating the drilling fluid in flow passage 543 from the clear oil in chamber 497.

It may be noted that bellows 479 and 545 are each closed at one end, whereas bellows 451 and 493 are open ended bellows.

If desirable or necessary, additional bellows 545 in additional recesses 545 communicating with flow passage 543 through additional ports 541 may be employed, e.g. as shown in FIG. 18, wherein a second group of such bellows is disposed below the first group in vertical alignment therewith (alternatively could be staggered).

HYDRAULIC JAR

Referring now to FIGS. 19–22 there is shown a hydraulic jar incorporating the sealed seal construction described above in connection with a vibration damper type of telescopic joint. The construction is basically the same as that of the damper and like parts are given the same reference numbers increased by 1000 and only the differences need be described in detail. The jar includes inner tube 1407 and an outer tube 1409 with a sliding pressure seal means 1453 therebetween. An upper oil filled chamber 1497 is formed between pressure seal means 1453 and an upper flexible seal means 1493. A lower oil filled chamber 1471 is formed between sliding pressure seal means 1453 and lower flexible seal means 1451. Above lower flexible seal means 1451 is lower bearing means 1472. Spline means 1505, above bearing means 1472, is in the lower chamber rather than in the upper chamber. Also in the lower chamber rather that in the upper chamber is upper bearing means 1499 above spline means 1505. Upper pressure equalizer and volume compensating means 1540 is provided for the upper chamber 1497 and lower pressure equalizer and volume compensating means 1474 (shown only in part) is provided for the lower chamber 1471. Upper electrode means 1513 and lower electrode means (not shown in FIG. 19 but the same as that shown at 474 in FIGS. 11 and 16) provide means for checking the electrical resistance of the oil in chambers 1497 and 1471. No resilient means is employed in the jar comparable to resilient means 507 of the damper. In fact in the jar there is no mechanical component housed in the upper chamber; the upper chamber merely provides protection for the upper side of the sliding pressure seal.

Figures 19, 20:
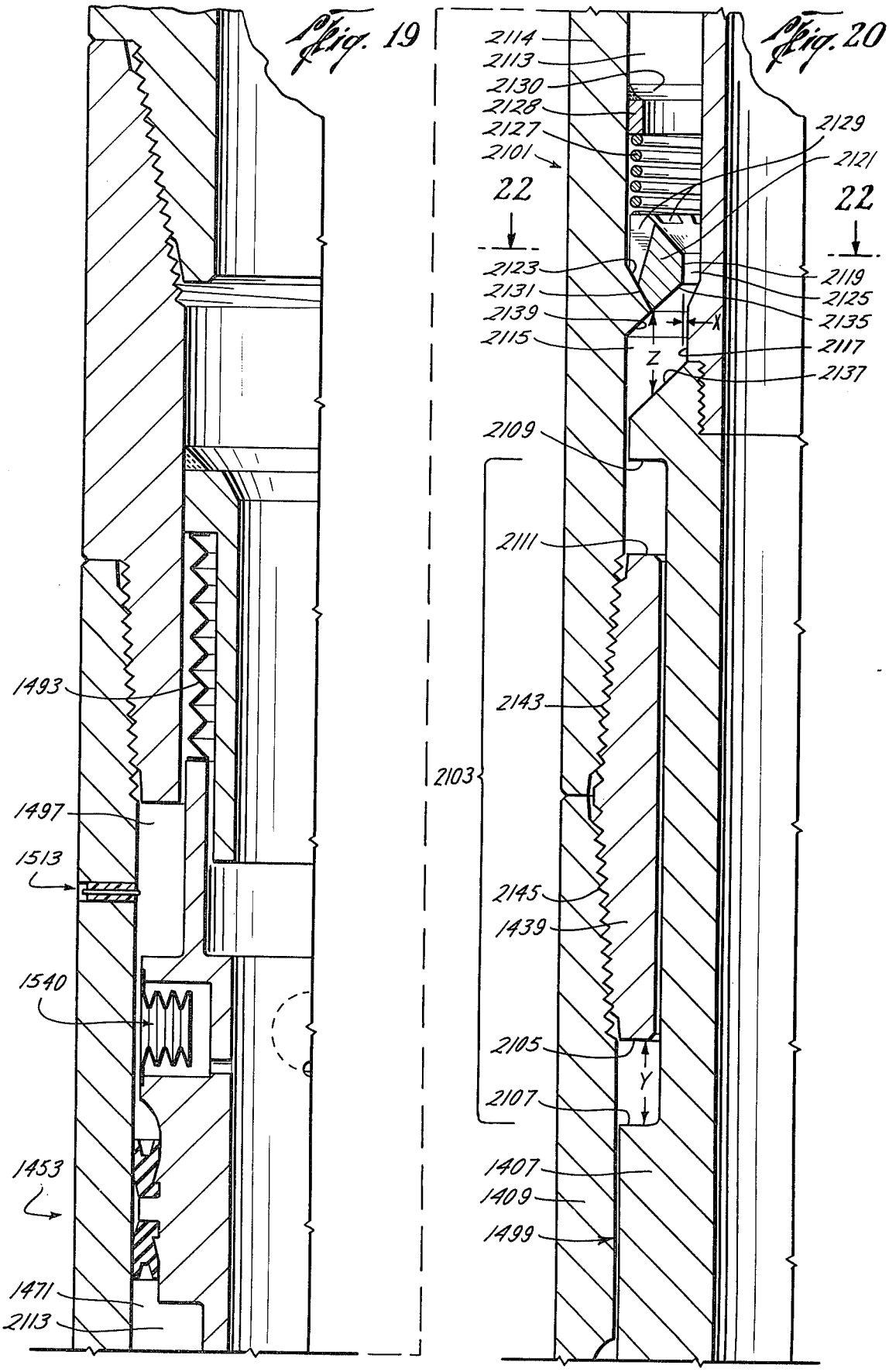

In the jar, however, there is provided in the lower chamber, just below the sliding pressure seal, hydraulic jar means 2101 (FIGS. 20 and 21). Such jar means includes lost motion telescopic connection 2103, including the relevant portions of the inner and outer tubes 1407, 1409, and downwardly and upwardly facing shoulders 2150, 2107 on the outer and inner tubes which provide lower travel limit means, and downwardly and upwardly facing shoulders 2109, 2111 on the inner and outer tubes forming lower travel limit means. To jar downwardly it is only necessary, after extending the jar to the full limit allowed by the lost motion connection, to release the weight of the drill pipe above the jar, causing the outer tube to fall down relative to the inner tube until travel is limited by lower travel limit shoulders 2105, 2107, thereby jarring down on the inner tube with the full momentum of the falling drill pipe and winding up with the static force of the pipe weight.

To jar up, after contracting the jar to the full limit allowed by the lost motion connection, an upward pull is taken on the drill pipe. Initially extension of the joint is resisted by the oil in the upper chamber 2113, which must flow from upper volume 2113 to lower volume 2115 through the clearance between the outer periphery 2117 of the inner tube and the inner periphery 2119 of tapered check valve ring 2121 resting on tapered seat 2123. A strain is therefore imposed on the drill pipe. As soon as enough oil has flowed from the upper volume to the lower volume to allow the jar to extend to a position in which the inner periphery of the valve ring is above the large diameter portion 2117 of the inner tube, there is suddenly opened a wide flow passage 2125 for the flow of oil from the upper volume to the lower volume. At this time the strain in the drill pipe is suddenly relieved by the outer tube moving up relative to the inner tube to the limit allowed by engagement of travel limit shoulders 2109, 2111, thereby jarring upwardly on the inner tube with the drill pipe momentum acquired as the strain in the drill pipe is relieved and winding up with the static force of the unrelieved resilient strain in the drill pipe. During both up and down jarring, change in the volume of the upper ahd lower oil filled chambers 1497, 1471 is compensated by volume compensation means 1540 and 1474.

Figure 22:
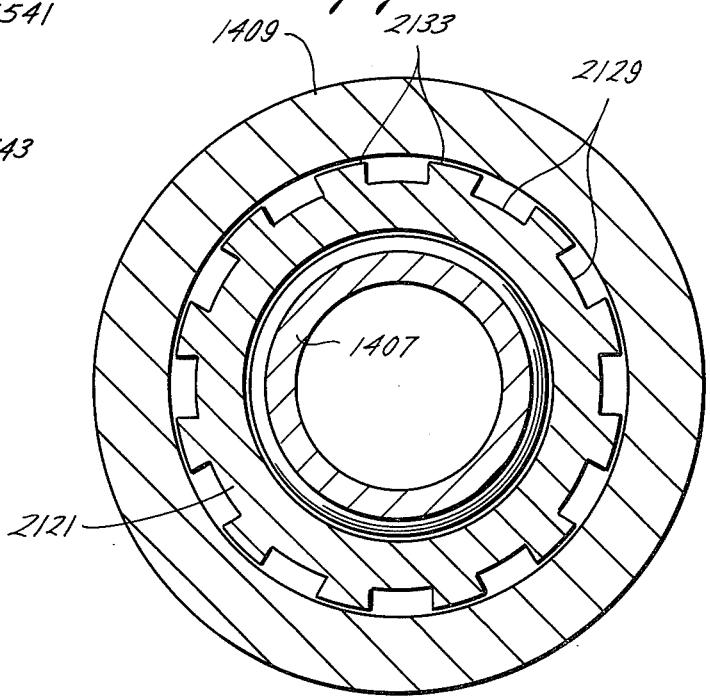
FIG. 22 is a section taken at plane 22—22 of FIG. 20.

During downward jarring, check valve ring 2119 lifts up off seat 2113 to permit free flow of oil from lower volume 2115 to upper volume 2113. Coil spring 2127 bearing against seat 2128 welded at 2130 to outer tube 2114 and bearing down on top of valve ring 2121 lightly biases the valve to closed position. Spring 2127 can be omitted if desired (see FIG. 23 modification), reliance being placed on the weight of the ring to urge it to valve closed position. As best shown in FIG. 22, ring 2121 is fluted at 2129 on its outer periphery above its seating surface 2132 to increase the flow passage when the valve is open, the valve ring being of close to the same outer diameter as the inner diameter of the outer tube adjacent thereto in order to provide cylindric guide surfaces 2133 for the ring.

Cylindrical inner surface 2119 of the check valve may be viewed as a seating surface seating with a loose or leaky fit about a seat provided by cylindrical surface 2117. Viewed in that manner, the valve comprising ring 2121, seat 2123, and seat 2117 is a leaky snap action check valve, permitting easy upflow of oil from volume 2118 to volume 2113 during down jarring, and providing initial resistance to downflow of oil preparatory to up jarring. The leak or clearance space when the valve is closed is indicated by the dimension X in FIG. 20.

In order to provide a more streamlined path for fluid flow during down jarring, the lower inner periphery 2135 of the valve ring is tapered, flaring downwardly, and the inner tube is provided with a correlatively tapered surface 2137. The underside 2139 of valve seat 2123 is tapered to form an extension or continuation of tapered under surface 2135 of the valve ring. With this arrangement, when the jar is contracted surface 2137 on the inner tube can abut both valve ring surface 2135, forming an additional seating engagement, and under surface 2139, forming a travel limit for the lost motion joint. In such case down jarring would occur additionally or solely at surfaces 2137 and 2139, taking the load off threaded connections 2143, 2145 of the outer tube. In the illustrated embodiment, dimension y and z are about equal so that during down jarring both sets of contraction travel limits come into operation. It will also be noted that during up jarring, all the threaded connections in the drill pipe will be placed in tension so the threaded connections 2143, 2145 will have no greater load imposed thereon than the rest of the drill pipe connections.

Referring now to FIG. 23, there is shown a modified form of the previously described jar in which spline means 1505 of FIG. 21 is replaced by spline means 2505 employing the buried pin spline construction disclosed in the aforementioned Kellner, et al patent. Reference numbers 1000 larger than those employed in the previously described jar construction makes possible easy correlation of like and similar parts so as to reduce the need for much description. Paraxial pins 2511 carried in grooves 2513 in buried pin 2439 engage correlative grooves 2497 on the outer surface of inner tube 2407. This shortens up on the length of the jar.

The check valve means employed in the FIG. 23 construction is similar to that of FIG. 20 except that no bias spring is employed, the under surface 3139 of valve seat 3123 is not tapered, nor is the under surface 3137 of the travel limit shoulder. The check valve is shown in closed position in FIG. 23. Other than as noted, the FIG. 23 construction will be the same as the sealed seal jar of FIGS. 19–22 and 18.

The sealed seal construction enables materials to be employed for the sliding pressure seal which are suitable for high temperature and high pressure conditions which could not be employed if the sliding seal had to work in a sandy, dirty drilling fluid environment.

While a preferred embodiment and a number of modifications of the invention have been shown and described, other modifications can be made by one skilled in the art without departing from the spirit of the invention.

I claim:

1. Well tool comprising a tubular barrel, a tubular mandrel axially slideably disposed in the barrel, spline means to transfer torque between the barrel and mandrel, means on the barrel at one end of the tool adapted for connection to a rotary drilling member, means on the mandrel at the other end of the tool adapted for connection to a rotary drilling member, stop means on the barrel and mandrel limiting relative axial movement thereof, first double anchored seal means between the barrel and mandrel sealing against flow of fluid between the interior of the tool and the annular clearance between the barrel and mandrel, while allowing relative axial motion between said barrel and mandrel, second double anchored seal means between the barrel and mandrel sealing against the flow of fluid between the exterior of the tool and said annular clearance between the barrel and mandrel while allowing relative axial motion between said barrel and mandrel, and sliding pressure seal means between said first and second double anchored seal means sealing against the flow of fluid axially through said annular clearance between the barrel and mandrel while allowing relative axial motion between said barrel and mandrel, said double anchored seal means each being annular and including a first annular periphery coaxial with and affixed to the barrel preventing relative axial and rotational movement between said first periphery and barrel, and a second annular periphery coaxial with and affixed to the mandrel preventing relative axial and rotational movement between said second periphery and mandrel, and an annular flexible portion coaxial with said first and second peripheries and flexibly interconnecting said peripheries and flexing upon relative axial motion of said peripheries while sealing therebetween, said double anchored seal means isolating said sliding pressure seal means and preventing contamination of the sliding seal means by fluid outside the barrel and preventing contamination of the sliding seal means by fluid inside the barrel.

2. Tool according to claim 1, said double anchored seal means each comprising a bellows attached at one end to the barrel and at the other end to the mandrel.

3. Tool according to claim 1, said double anchored seal means being open ended bellows, each affixed in fluid tight relationship at one end to said mandrel and at the other end to said barrel.

4. Tool according to claim 3, each said bellows extending paraxially of the tool in a protective pocket.

5. Tool according to claim 1, said sliding seal means comprising a pair of oppositely facing double lip seal rings, each ring facing the flexible seal means of the adjacent chamber.

6. Tool according to claim 5, said sliding seal means including an annular backup shoulder around the mandrel, said double lip seal rings being disposed around said mandrel on opposite sides of and in engagement with said shoulder.

7. Tool according to claim 6, said mandrel having barb cross section annular lock shoulders therearound, one lock shoulder on each side of said backup shoulder axially spaced therefrom, each seal ring having an inner peripheral groove correlative to the lock shoulder at the respective side of the backup shoulder, whereby said seal rings are locked against axial motion away from said backup shoulder.

8. Tool according to claim 7, each seal ring including a plurality of metal leaf spreader springs positioned between its lips and circumferentially spaced apart therearound.

9. Tool according to claim 1, said sliding seal means being made of high temperature, low gas absorptivity material such as polytetrafluorethylene.

10. Tool according to claim 8, said double anchored seal means being made of metal such as stainless steel.

11. Tool according to claim 1, including spline means in one of said chambers for transmitting torque between said barrel and mandrel while allowing relative axial motion of the barrel and mandrel within the limits of said travel stops.

12. Tool according to claim 11, said spline means comprising a buried split pin in said barrel having a plurality of rods disposed in axially extending pockets in the inner periphery of the pin engaging in axially extending slots in the mandrel.

13. Tool according to claim 11, including bearing means in a one of said chambers to transmit side thrust between said barrel and mandrel.

14. Tool according to claim 13, including further bearing means in a one of said chambers to transmit side thrust between said barrel and mandrel, said bearing means and further bearing means being axially separated to enhance capacity for transmitting bending moment between said barrel and mandrel.

15. Tool according to claim 14, said bearing means being in one chamber and said further bearing means being in the other chamber.

16. Tool according to claim 13, said spline means and bearing means being in different chambers.

17. Tool according to claim 15, the bearing means in the same chamber as the spline means being disposed so that the spline means is between the last said bearing means and said sliding seal means.

18. Tool according to claim 13 including force means in one of said chambers to transmit axial force between said mandrel and barrel.

19. Tool according to claim 17, said force means being a resilient means to reduce the transmission of vibration and impact between said barrel and mandrel.

20. Tool according to claim 17, said force means being a double acting stack of Belleville springs.

21. Tool according to claim 17, said force means being hydraulic jar means.

22. Tool according to claim 21, said jar means comprising snap action leaky check valve means in one of said chambers which is filled with oil restricting flow of oil from one side of said check valve means to the other in the direction away from said sliding seal means upon relative motion of the barrel and mandrel.

23. Tool according to claim 22, said check valve means comprising an annular shoulder on one of said barrel and mandrel providing a primary valve seat, a cylindrical surface on the other of said barrel and member providing a leaky seat, a valve ring urged against said valve seat having shoulder and cylindrical sealing surfaces correlative to said seats except that the fit with said leaky seat leaves a clearance of between 1/32 and 1/10 inch on a diameter of between 2 and 6 inches or the equivalent, said cylindrical valve seat and sealing surface separating upon a predetermined relative axial movement of said barrel and mandrel from valve closed position.

24. Tool according to claim 23, said primary valve seat and correlative seating surface being tapered flaring in the direction away from the primary seat, said shoulder forming said primary seat being tapered on its underside which is the side opposite from said primary valve seat, said valve ring having an under side adjacent its tapered seating surface which is tapered to form a continuation of the taper of the under side of said shoulder, said cylindrical seat having adjacent thereto a tapered portion flaring the same direction as said under side of said shoulder.

25. Tool according to claim 24 including spring means biasing said valve ring toward engagement with said primary seat.

26. Well tool comprising a tubular barrel, a tubular mandrel axially slideably disposed in the barrel, spline means to transfer torque between the barrel and mandrel, means on the barrel at one end of the tool adapted for connection to a rotary drilling member, means on the mandrel at the other end of the tool adapted for connection to a rotary drilling member, stop means on the barrel and mandrel limiting relative axial movement thereof, first flexible seal means between the barrel and mandrel sealing against flow of fluid between the interior of the tool and the annular clearance between the barrel and mandrel, while allowing relative axial motion between said barrel and mandrel, second flexible seal means between the barrel and mandrel sealing against the flow of fluid between the exterior of the tool and said annular clearance between the barrel and mandrel while allowing relative axial motion between said barrel and mandrel, and sliding seal means between said first and second flexible seal means sealing against the flow of fluid axially through said annular clearance between the barrel and mandrel while allowing relative axial motion between said barrel and mandrel, said sliding seal means dividing said clearance into an inner chamber between said sliding seal means and the one of said flexible seal means that is exposed to fluid pressure inside the mandrel and an outer chamber between said sliding seal means and the one of said flexible seal means that is exposed to fluid pressure outside the barrel, liquid in one of said chambers, and pressure equalizing and volume compensating means in a wall of said one of said chambers which wall is formed by the one of said barrel and mandrel that is exposed to the same fluid pressures as the flexible seal means forming said one of said chambers, to equalize the pressure of the liquid on opposite sides of the last said flexible seal means without loss of fluid from said one of said chambers despite changes in the volume of said clearance upon relative axial movement of said barrel and mandrel within the limits of said stop means.

27. Tool according to claim 26, liquid in the other of said chambers, and pressure equalizing and volume compensating means in the other of said barrel and mandrel to equalize the pressure of the liquid on opposite sides of the flexible seal means of said other of said chambers.

28. Tool according to claim 26, or 27, said flexible seal means being open ended bellows, each affixed in fluid tight relationship at one end to said mandrel and at the other end to said barrel.

29. Tool according to claim 28, each said bellows extending paraxially of the tool in a protective pocket.

30. Tool according to claim 26, or 27, said pressure equalizing and volume compensating means each comprising a bellows closed at one end and secured in fluid tight relationship at the other end around a port in the respective one of said barrel and mandrel.

31. Tool according to claim 29, each pocket comprising one tubular wall formed by a portion of one of the barrel and mandrel and another coaxial tubular wall formed by a portion of one of the barrel and mandrel telescoping relative to a portion of the other of said barrel and mandrel.

32. Tool according to claim 31, each bellows being positioned in a protective pocket formed in a wall in the respective one of said barrel and mandrel.

33. Tool according to claim 31, each pressure equalizing and volume compensating means comprising a plurality of said ports, and bellows circumferentially spaced apart about the respective one of said barrel and mandrel.

34. Tool according to claim 32, there being a plurality of axially spaced rings of said ports and bellows.

35. Tool according to claim 26 or 27, said sliding seal means comprising a pair of oppositely facing double lip seal rings, each ring facing the flexible seal means of the adjacent chamber.

36. Tool according to claim 35, said seal means including an annular backup shoulder around the mandrel, said double lip seal rings being disposed around said mandrel on opposite sides of and in engagement with said shoulder.

37. Tool according to claim 36, said mandrel having barb cross section annular lock shoulders therearound, one lock shoulder on each side of said backup shoulder axially spaced therefrom, each seal ring having an inner peripheral groove correlative to the lock shoulder at the respective side of the backup shoulder, whereby said seal rings are locked against axial motion away from said backup shoulder.

38. Tool according to claim 37, each seal ring including a plurality of metal leaf spreader springs positioned between its lips and circumferentially spaced apart therearound.

39. Tool according to claim 26 or 27, said sliding seal means being made of high temperature, low gas absorptivity material such as polytetrafluorethylene.

40. Tool according to claim 38, said flexible seal means being made of metal such as stainless steel.

41. Tool according to claim 26 or 27, including spline means in one of said chambers for transmitting torque between said barrel and mandrel while allowing relative axial motion of the barrel and mandrel within the limits of said travel stops.

42. Tool according to claim 41, said spline means comprising a buried split pin in said barrel having a plurality of rods disposed in axially extending pockets in the inner periphery of the pin engaging in axially extending slots in the mandrel.

43. Tool according to claim 41, including bearing means in a one of said chambers to transmit side thrust between said barrel and mandrel.

44. Tool according to claim 43 including further bearing means in a one of said chambers to transmit side thrust between said barrel and mandrel, said bearing means and further bearing means being axially separated to enhance capacity for transmitting bending moment between said barrel and mandrel.

45. Tool according to claim 44 said bearing means being in one chamber and said further bearing means being in the other chamber.

46. Tool according to claim 43, said spline means and bearing means being in different chambers.

47. Tool according to claim 45, the bearing means in the same chamber as the spline means being disposed so that the spline means is between the last said bearing means and said sliding seal means.

48. Tool according to claim 43 including force means in one of said chambers to transmt axial force between said mandrel and barrel.

49. Tool according to claim 48, said force means being resilient means to reduce the transmission of vibration and impact between said barrel and mandrel.

50. Tool according to claim 48, said force means being a double acting stack of Belleville springs.

51. Tool according to claim 48, said force means being hydraulic jar means.

52. Tool according to claim 51, said jar means comprising snap action leaky check valve means in one of said chambers which is filled with oil restricting flow of oil from one side of said check valve means to the other in the direction away from said sliding seal means upon relative motion of the barrel and mandrel.

53. Tool according to claim 52, said check valve means comprising an annular shoulder on one of said barrel and mandrel providing a primary valve seat, a cylindrical surface on the other of said barrel and member providing a leaky seat, a valve ring urged against said valve seat having shoulder and cylindrical sealing surfaces correlative to said seats except that the fit with said leaky seat leaves a clearance of between 1/32 and 1/10 inch on a diameter of between 2 and 6 inches or the equivalent, said cylindrical valve seat and sealing surface separating upon a predetermined relative axial movement of said barrel and mandrel from valve closed position.

54. Tool according to claim 53, said primary valve seat and correlative seating surface being tapered flaring in the direction away from the primary seat, said shoulder forming said primary seat being tapered on its underside which is the side opposite from said primary valve seat, said valve ring having an under side adjacent its tapered seating surface which is tapered to form a continuation of the taper of the under side of said shoulder, said cylindrical seat having adjacent thereto a tapered portion flaring the same direction as said under side of said shoulder.

55. Tool according to claim 51 including spring means biasing said valve ring toward engagement with said primary seat.

56. Well tool comprising a tubular barrel, a tubular mandrel axially slideably disposed in the barrel, spline means to transfer torque between the barrel and mandrel, means on the barrel at one end of the tool adapted for connection to a rotary drilling member, means on the mandrel at the other end of the tool adapted for connection to a rotary drilling member, stop means on the barrel and mandrel limiting relative axial movement thereof, first flexible seal means between the barrel and mandrel sealing against flow of fluid between the interior of the tool and the annular clearance between the barrel and mandrel, while allowing relative axial motion between said barrel and mandrel, second flexible seal means between the barrel and mandrel sealing against the flow of fluid between the exterior of the tool and said annular clearance between the barrel and mandrel while allowing relative axial motion between said barrel and mandrel, and sliding seal means between said first and second flexible seal means sealing against the flow of fluid axially through said annular clearance between the barrel and mandrel while allowing relative axial motion between said barrel and mandrel, said flexible seal means each being annular and including a first periphery affixed to the barrel and a second periphery affixed to the mandrel, said flexible seal means being open ended bellows, each affixed in fluid light relationship at one end to said mandrel and at the other end to said barrel, each said bellows extending paraxially of the tool in a protective pocket, each pocket comprising one tubular wall formed by a portion of one of the barrel and mandrel and another coaxial wall formed by a portion of one of the barrel and mandrel telescoping relative to a portion of the other of said barrel and mandrel.

57. Tool according to claim 56, each bellows being positioned in a protective pocket formed in a wall in the respective one of said barrel and mandrel.

* * * * *

UNITED STATES PATENT AND TRADEMARK OFFICE

CERTIFICATE OF CORRECTION

PATENT NO. : 4,434,863

DATED : MARCH 6, 1984

INVENTOR(S) : WILLIAM R. GARRETT

It is certified that error appears in the above—identified patent and that said Letters Patent is hereby corrected as shown below:

In the Abstract

Line 2; change "weel" to --well--.

Line 16; delete "of this".

Column 10, line 3; change "Hiebel" to --Hebel--.

Column 10, line 10; change "Hiebel" to --Hebel--

Column 17, line 23; change "ransmit" to --transmit--.

Column 20, line 44; change "$R_2$" to --R"--.

Column 31, line 11; change "that" to --than--.

UNITED STATES PATENT AND TRADEMARK OFFICE

CERTIFICATE OF CORRECTION

PATENT NO. : 4,434,863

DATED : MARCH 6, 1984

INVENTOR(S) : WILLIAM R. GARRETT

It is certified that error appears in the above—identified patent and that said Letters Patent is hereby corrected as shown below:

In the Claims

Claim 19, line 1; change "17" to --18--;
line 2, cancel "a".

Claim 20, line 1; change "17" to --18--.

Claim 21, line 1; change "17" to --18--.

Claim 55, line 1; change "51" to --54--.

Claim 56, line 33, change "light" to --tight--.

Signed and Sealed this

*Twenty-fourth* Day of *July 1984*

[SEAL]

*Attest:*

GERALD J. MOSSINGHOFF

*Attesting Officer*

*Commissioner of Patents and Trademarks*